US010878749B2

(12) United States Patent
Lee et al.

(10) Patent No.: US 10,878,749 B2
(45) Date of Patent: Dec. 29, 2020

(54) DISPLAY DEVICE AND DRIVING METHOD THEREOF

(71) Applicant: SAMSUNG DISPLAY CO., LTD., Yongin-si (KR)

(72) Inventors: Jae Sic Lee, Yongin-si (KR); Seung Yeon Cho, Yongin-si (KR); Sang Moo Choi, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 91 days.

(21) Appl. No.: 15/621,481

(22) Filed: Jun. 13, 2017

(65) Prior Publication Data

US 2018/0075803 A1 Mar. 15, 2018

(30) Foreign Application Priority Data

Sep. 12, 2016 (KR) ..... 10-2016-0117540

(51) Int. Cl.

| | |
|---|---|
| ***G09G 3/3233*** | (2016.01) |
| ***G09G 3/20*** | (2006.01) |
| ***G09G 3/3208*** | (2016.01) |
| ***G09G 3/3266*** | (2016.01) |
| ***G09G 3/3275*** | (2016.01) |

(52) U.S. Cl.

CPC ..... *G09G 3/3233* (2013.01); *G09G 3/20* (2013.01); *G09G 3/3208* (2013.01); *G09G 3/3266* (2013.01); *G09G 3/3275* (2013.01); *G09G 2300/0861* (2013.01); *G09G 2310/0205* (2013.01); *G09G 2310/0267* (2013.01); *G09G 2310/0283* (2013.01); *G09G 2310/08* (2013.01); *G09G 2320/0233* (2013.01); *G09G 2320/0686* (2013.01)

(58) Field of Classification Search

CPC .. G09G 3/3233; G09G 3/3266; G09G 3/3688; G09G 3/20

See application file for complete search history.

(56) References Cited

U.S. PATENT DOCUMENTS 5,754,160 A 5/1998 Shimizu et al.
6,819,311 B2 * 11/2004 Nose ..... G09G 3/3648 345/100

(Continued)

FOREIGN PATENT DOCUMENTS

KR 10-1152466 5/2012
KR 10-2012-0065137 6/2012

(Continued)

OTHER PUBLICATIONS

Extended European Search Report was issued from the European Patent Office dated Oct. 9, 2017 with respect to the European Patent Application No. 17188152.7.

*Primary Examiner* — William Boddie
*Assistant Examiner* — Alecia D English
(74) *Attorney, Agent, or Firm* — Kile Park Reed & Houtteman PLLC

(57) ABSTRACT

A display device includes a plurality of first pixels coupled to first scan lines and data lines and a plurality of second pixels coupled to second scan lines and the data lines. Each of the first scan lines receives 2i first scan signals during a frame period. Each of the second scan lines receives i second scan signals during the frame period, where i is a natural number.

22 Claims, 19 Drawing Sheets

(56) References Cited

U.S. PATENT DOCUMENTS

| | | | | |
|---|---|---|---|---|
| 7,420,551 | B2 * | 9/2008 | Kota | G03B 1/00 345/208 |
| 8,072,410 | B2 * | 12/2011 | Park | G09G 3/3677 345/100 |
| 8,803,770 | B2 | 8/2014 | Jeong et al. | |
| 8,994,619 | B2 | 3/2015 | Jeong | |
| 9,088,742 | B2 | 7/2015 | Kimura | |
| 9,330,593 | B2 | 5/2016 | Jang | |
| 9,330,601 | B2 * | 5/2016 | Lee | G09G 3/3233 |
| 9,443,464 | B2 | 9/2016 | Song et al. | |
| 2007/0052658 | A1 * | 3/2007 | Kim | G09G 3/3648 345/100 |
| 2013/0181964 | A1 | 7/2013 | Tsai et al. | |
| 2016/0180823 | A1 * | 6/2016 | Cho | G09G 5/18 345/567 |
| 2016/0203794 | A1 * | 7/2016 | Lim | G09G 3/3225 345/213 |

FOREIGN PATENT DOCUMENTS

| | | |
|---|---|---|
| KR | 10-2012-0071197 | 7/2012 |
| KR | 10-2013-0143318 | 12/2013 |
| KR | 10-2014-0038148 | 3/2014 |

* cited by examiner

DISPLAY DEVICE AND DRIVING METHOD THEREOF

CROSS-REFERENCE TO RELATED APPLICATION

Korean Patent Application No. 10-2016-0117540, filed on Sep. 12, 2016, and entitled: "Display Device and Driving Method Thereof," is incorporated by reference herein in its entirety.

BACKGROUND

1. Field

One or more embodiments described herein relate to a display device and a method for driving a display device.

2. Description of the Related Art

A variety of displays have been developed. Examples include liquid crystal displays and organic light emitting displays. An organic light emitting display generates an image based on light emitted from pixels that are coupled to scan lines and data lines. Each pixel includes a driving transistor for controlling the amount of current supplied to an organic light emitting diode based on a data signal. This current controls the amount of emitted light, e.g., luminance.

Various methods have been proposed to control a driving transistor. One method involves applying a bias voltage (on or off bias) to the driving transistor while a scan signal is applied to a corresponding scan line. In order to retain image quality, some display devices have dummy scan lines and dummy pixels. However, the dummy scan lines and dummy pixels may increase the amount of dead space in the display.

SUMMARY

In accordance with one or more embodiments, a display device includes a plurality of first pixels coupled to first scan lines and data lines; and a plurality of second pixels coupled to second scan lines and the data lines, wherein each of the first scan lines is to receive 2i first scan signals during a frame period and each of the second scan lines is to receive i second scan signals during the frame period, where i is a natural number.

The display device may include a first scan driver to supply the 2i first scan signals to each of the first scan lines; and a second scan driver to supply the i second scan signals to each of the second scan lines. The display device may include a timing controller to supply a first start signal and a third start signal to the first scan driver and to supply a second start signal to the second scan driver. The second scan driver may supply the i second scan signals to each of the second scan lines based on the second start signal.

The first scan driver may supply i first scan signals to each of the first scan lines based on the first start signal; and supply i first scan signals to each of the first scan lines based on the second start signal. At least one first scan signal, among the first scan signals supplied to each of the first scan lines based on the second start signal, may overlap a second scan signal finally supplied during the frame period. The first start signal and the second start signal may have a same width. The timing controller may sequentially supply the first start signal, the second start signal, and the third start signal.

The display device may include a first scan driver to supply i first scan signals to each of the first scan lines; a second scan driver to supply i second scan signals to each of the second scan lines; and a third scan driver to supply i third scan signals to each of the first scan lines. The second scan driver may output the second scan signal based on an output signal of the first scan driver. The third scan driver may output the third scan signal based on an output signal of the second scan driver. The display device may include a timing controller to supply a start signal to the first scan driver. The value of i may be 2 or three or more.

The display device may include a data driver to supply a data signal to the data lines; and a light emitting driver to supply a light emitting control signal to light emitting control lines coupled to the first pixels and the second pixels. The display device may include a demultiplexer coupled between the data driver and the data lines.

In accordance with one or more other embodiments, a display device includes a plurality of first pixels coupled to first scan lines and data lines; a plurality of second pixels coupled to second scan lines and the data lines; a first scan driver to supply 2(i−1) first scan signals to each of the first scan lines; and a second scan driver to supply i second scan signals to each of the second scan lines.

The display device may include a timing controller to supply a first start signal and a third start signal to the first scan driver and top supply a second start signal to the second scan driver. The first start signal and the third start signal may have a narrower width than the second start signal. The timing controller may sequentially supply the first start signal, the second start signal, and the third start signal. The second scan driver may sequentially supply the i second scan signals to each of the second scan lines based on the second start signal.

The first scan driver may supply some first scan signals among the 2(i−1) first scan signals to each of the first scan lines when the first start signal is supplied; and supply the other first scan signals among the 2(i−1) first scan signals to each of the first scan lines when the third start signal is supplied. At least one first scan signal, among the other first scan signals to be supplied to each of the first scan lines, may overlap a second scan signal finally supplied during a frame period. The value of is may be 2 or 3 or more.

The display device may include a data driver to supply a data signal to the data lines; and a light emitting driver to supply a light emitting control signal to light emitting control lines coupled to the first pixels and the second pixels. The display device may include a DEMUX coupled between the data driver and the data lines.

In accordance with one or more other embodiments, a method for driving a display device includes supplying at least one first scan signal to each of first scan lines based on a first start signal; supplying two or more second scan signals to each of second scan lines based on a second start signal; and supplying at least one third scan signal to each of the first scan lines based on a third start signal. The first start signal, the second start signal, and the third start signal may be sequentially supplied. The at least one third scan signal supplied to each of the first scan lines may overlap a second scan signal finally supplied during a frame period. The first start signal, the second start signal, and the third start signal may have a same width. The first start signal and the second start signal may have different widths. The first start signal may have a narrower width than the second start signal. The first and third start signals may have a same width.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
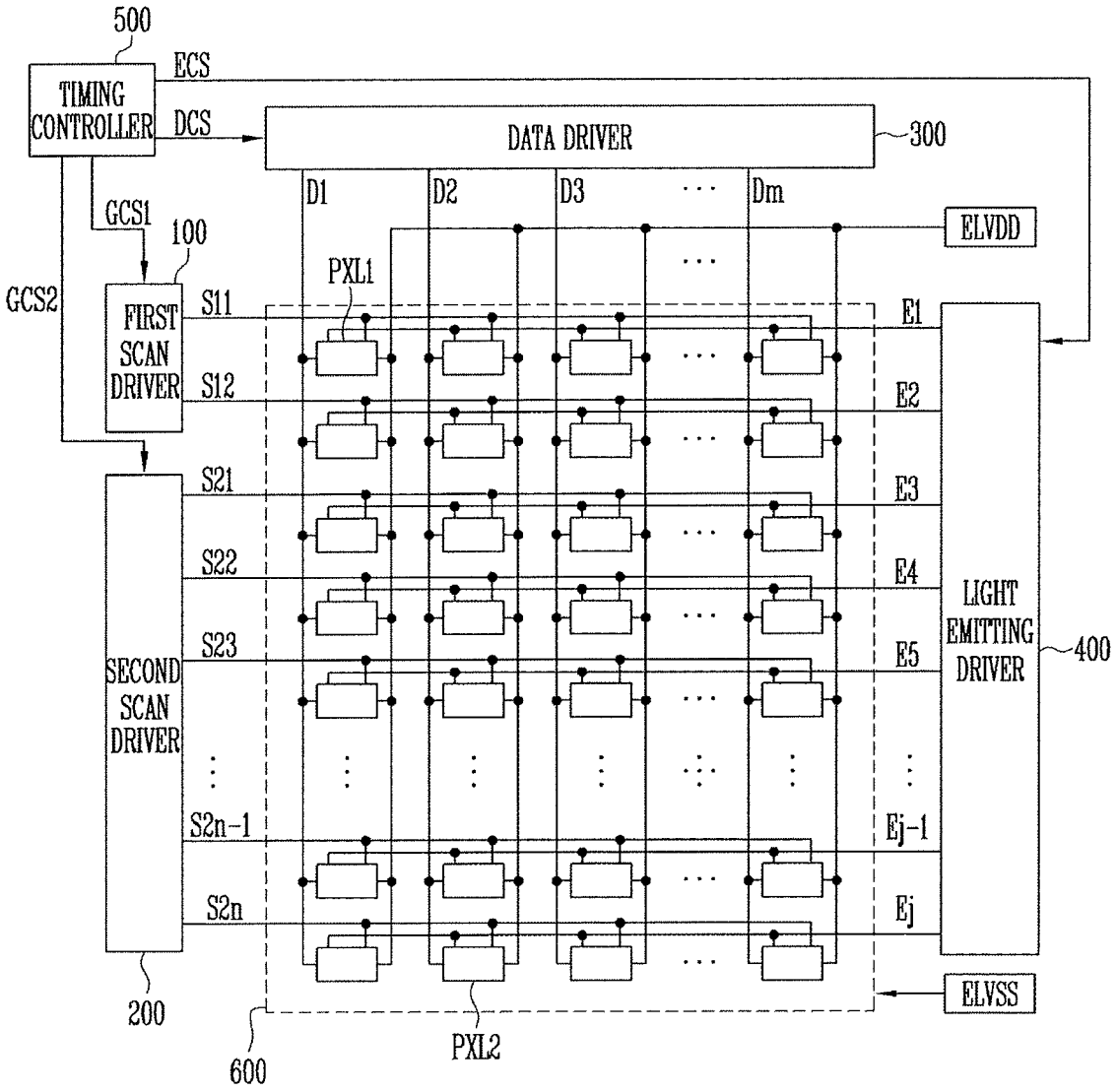
FIG. 1 illustrates an embodiment of a display device.

Example embodiments are described with reference to the drawings; however, they may be embodied in different forms and should not be construed as limited to the embodiments set forth herein. Rather, these embodiments are provided so that this disclosure will be thorough and complete, and will fully convey exemplary implementations to those skilled in the art. Applicants request the Examiner to withdraw this rejection for at least the following reasons.

In the drawings, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

When an element is referred to as being "connected" or "coupled" to another element, it can be directly connected or coupled to the another element or be indirectly connected or coupled to the another element with one or more intervening elements interposed therebetween. Further, some of the elements that are not essential to the complete understanding of the disclosure are omitted for clarity. Also, like reference numerals refer to like elements throughout.

FIG. 1 illustrates an embodiment of a display device which includes a first scan driver 100, a second scan driver 200, a data driver 300, a light emitting driver 400, a timing controller 500, and a pixel unit 600. The pixel unit 600 includes first pixels PXL1 and second pixels PXL2 for generating a predetermined image. The pixel unit 600 may be considered as an effective display unit.

The first pixels PXL1 are coupled to first scan lines S11 and S12 and data lines D1 to Dm. The first pixels PXL1 are selected when a first scan signal is supplied to the scan lines S11 and S12. The selected pixels PXL1 receive data signals from the data lines D1 to Dm. Each of the first pixels PXL1 receive a data signal to generate light with a predetermined luminance. This luminance is based on the amount of current flowing from a first power source ELVDD to a second power source ELVSS, via an organic light emitting diode. The light emitting time of the first pixels PXL1 is controlled based on a light emitting control signal from light emitting control lines E1 and E2.

The second pixels PXL2 are coupled to second scan lines S21 to S2*n* and the data lines D1 to Dm. The second pixels PXL2 are selected when a second scan signal is supplied to the second scan lines S21 and S2*n*. The second pixels PXL2 receives a data signal from the data lines D1 to Dm. Each of the second pixels PXL2 receive a data signal to generate light with a predetermined luminance. The luminance is generated based on the amount of current flowing from the first power source ELVDD to the second power source ELVSS, via an organic light emitting diode. The light emitting time of the second pixels PXL2 is controlled based on a light emitting control signal from light emitting control lines E3 to Ej.

In one embodiment, the first pixels PXL1 and the second pixels PXL2 may be implemented with various types of circuits that include a driving transistor.

Although two first scan lines S11 and S12 are in FIG. 1, the number of the first scan lines S11 and S12 in the pixel unit 600 may be set corresponding to the number of second scan signals supplied to each of the second scan lines S21 and S2*n*. In FIG. 1, two second scan signals are supplied to each of the second scan lines S21 to S2*n*, and two first scan lines S11 and S12 are in the pixel unit 600, corresponding to the two second scan signals.

Based on a first gate control signal GCS1 from the timing controller 500, the first scan driver 100 supplies 2i (i is a natural number) or 2(i−1) first scan signals to each of the first scan lines S11 and S12 during a frame period. For example, when i is set to 2, the first scan driver 100 may supply four first scan signals or two first scan signals to each of the first scan lines S11 and S12. When the first scan signals are supplied to the first scan lines S11 and S12, the first pixels PXL1 are sequentially selected in units of horizontal lines. The first scan signal is set to a gate-on voltage to turn on transistors in the first pixels PXL1.

Based on a second gate control signal GCS2 from the timing controller 500, the second scan driver 200 supplies i second scan signals to each of the second scan lines S21 to S2*n* during a frame period. For example, the second scan driver 200 may supply two second scan signals to each of the second scan lines S21 to S2*n*. When the second scan signals are supplied to the second scan lines S21 to S2*n*, the second pixels PXL2 are sequentially selected in units of horizontal lines. The second scan signal is set to a gate-on voltage to turn on transistors in the second pixels PXL2.

In FIG. 1, the first scan driver 100 and the second scan driver 200 are located at one side of the pixel unit 600. In one embodiment, the first scan driver 100 and the second scan driver 200 may be located at different sides of the pixel unit 600.

The light emitting driver 400 receives an emission control signal ECS from the timing controller 500 and sequentially supplies a light emitting control signal to the light emitting control lines E1 to Ej. The light emitting control signal controls the light emitting time of pixels PXL1 and PXL2. The light emitting signal is set to a gate-off voltage to turn off the transistors in pixels PXL1 and PXL2.

The data driver 300 receives a data control signal DCS from timing controller 500 and supplies data signals to the data lines D1 to Dm. The data signals supplied to the data lines D1 to Dm are supplied to pixels PXL1 and PXL2 selected by the first and second scan signals.

The timing controller 500 generates the first gate control signal GCS1, the second gate control signal GCS2, the data control signal DCS, and the emission control signal ECS, based on timing signals supplied from an external source. The first gate control signal GCS1 generated by the timing controller 500 is supplied to the first scan driver 100. The second gate signal GCS2 generated by the timing controller 500 is supplied to the second scan driver 200. In addition, the data control signal DCS generated by the timing controller 500 is supplied to the data driver 300. The emission control signal ECS generated by the timing controller 500 is supplied to the light emitting driver 400.

The first gate control signal GCS1 includes a first start signal, a third start signal, clock signals, and the like. The first start signal and the third start signal control the supply timing of the first scan signals. The clock signals are used as a basis for shifting the first start signal and the third start signal.

The second gate control signal GCS2 includes a second start signal, clock signals, and the like. The second start signal controls the supply timing of the second scan signals. The clock signals are used as a basis for shifting the second start signal.

The data control signal DCS includes a source start signal, a source output enable signal, a source sampling clock, and the like. The source start signal controls a data sampling start point of the data driver 300. The source sampling clock controls a sampling operation of the data driver 300 based on the rising or falling edge. The source output enable signal controls the output timing of the data driver 300.

The emission control signal ECS includes an emission start signal and clock signals. The emission start signal controls the supply timing of the light emitting control signal. The clock signals are used as a basis for shifting the emission start signal.

Figure 2:
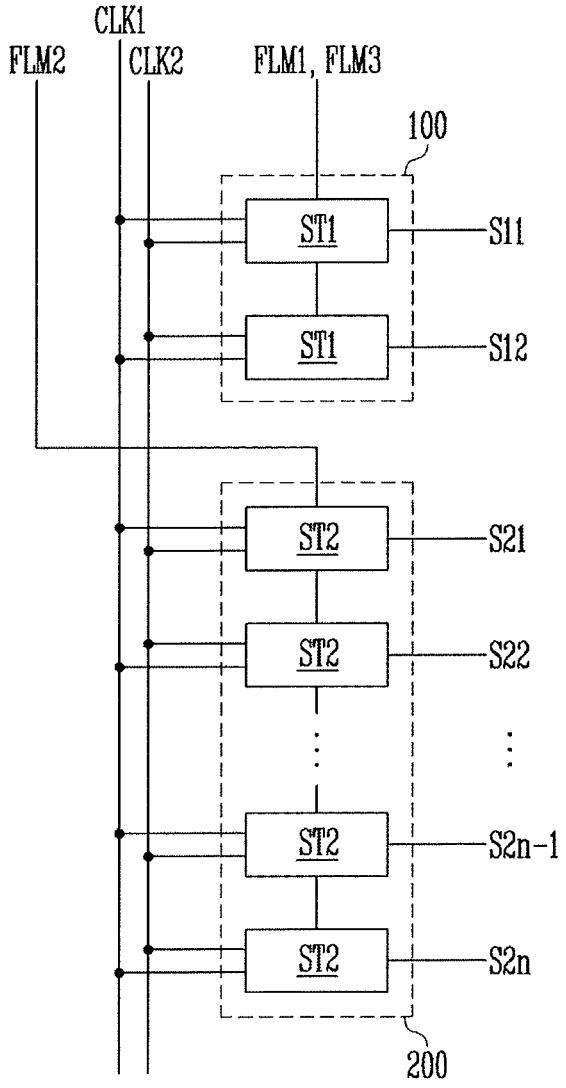
FIG. 2 illustrates an embodiment of scan drivers.

FIG. 2 illustrates an embodiment of the scan drivers 100 and 200 in FIG. 1. Referring to FIG. 2, the first scan driver 100 includes first stages ST1 respectively coupled to the first scan lines S11 and S12. The first stages ST1 receive clock signals CLK1 and CLK2 and supply first scan signals to respective first scan lines S11 and S12 based on a first start signal FLM1 and a third start signal FLM3.

The primary first stage ST1 supplies first scan signals to a primary first scan line S11 based on the first start signal FLM1 and the third start signal FLM3. A secondary first stage ST1 supplies first scan signals to a secondary first scan line S12 based on an output signal (e.g., a signal obtained by shifting the first start signal FLM1 and the third start signal FLM3) of the primary first stage ST1.

The number of first scan signals supplied to each of the first scan lines S11 and S12 is determined based on the width of the first start signal FLM1 and the third start signal FLM3. For example, a larger number of first scan signals are supplied to each of the first scan lines S11 and S12 as the widths of the first start signal FLM1 and the third start signal FLM3 increase. In an embodiment, the width of the first start signal FLM1 and the third start signal FLM3 may be controlled to supply 2i or 2(i−1) first scan signals to each of the first scan lines S11 and S12.

Second stages ST2 receive the clock signals CLK1 and CLK2 and supply second scan signals to the respective second scan lines S21 to S2*n* based on a second start signal FLM2.

A primary second stage ST2 supplies second scan signals to a primary second scan line S21 based on the second start signal FLM2. In addition, each of the other second stages ST2 supplies second scan signals to a second scan line (one of S22 to S2*n*) based on an output signal (e.g., a signal obtained by shifting the second start signal FLM2) of a previous stage.

The number of second scan signals supplied to each of the second scan lines S21 to S2*n* is determined based on the width of the second start signal FLM2. For example, a larger number of second scan signals are supplied to each of the second scan lines S21 to S2*n* as the width of the second start signal FLM2 increases. In an embodiment, the width of the second start signal FLM2 may be controlled to supply i second scan signals to each of the second scan lines S21 to S2*n*.

In one embodiment, the stages ST1 and ST2 may control the number of scan signals supplied to a scan line based on the width of a start signal FLM. The stages ST1 and ST2 may be implemented with various types of circuits.

Figure 3A:
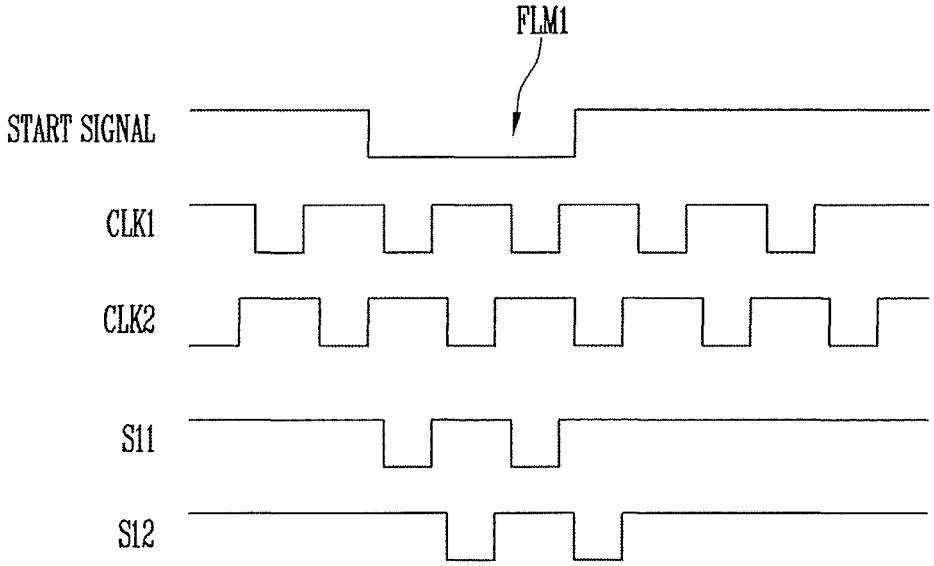
FIGS. 3A and 3B illustrate embodiments of waveforms for controlling the operation of the first stages.
Figure 3B:
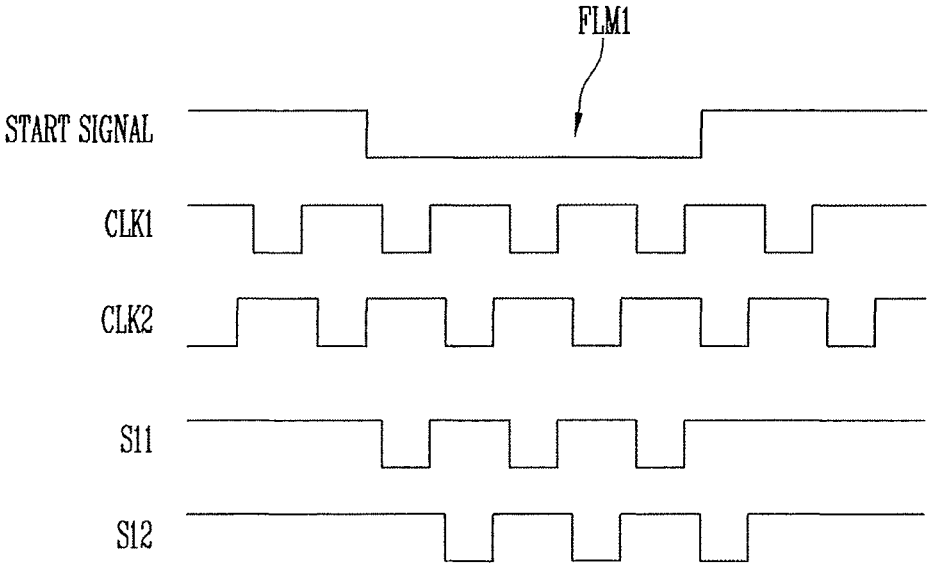

FIGS. 3A and 3B illustrate embodiments of waveforms for controlling operation of the first stages in FIG. 2. Referring to FIGS. 3A and 3B, the first start signal FLM1 is supplied to the primary first stage ST1 with a predetermined width. The primary first stage ST1 may supply, as a first clock signal, first clock signals CLK1 to overlap the first start signal FLM1 to the primary first scan line S11.

As illustrated in FIG. 3A, the primary first stage ST1 may supply, as the first scan signal, two first clock signals overlapping the first start signal FLM1 to the primary first scan line S11. As illustrated in FIG. 3B, the primary first stage ST1 may supply, as the first scan signal, three first clock signals CLK1 overlapping the first start signal FLM1 to the primary first scan line S11.

The secondary first stage ST1 may supply, as a second scan signal, second clock signals CLK2 to overlap an output signal (e.g., the first start signal FLM1 shifted by a half period of the first clock signal CLK1) of the primary first stage ST1 to the secondary first scan line S12. In one embodiment, the second stages ST2 may be driven by the same method as the first stages ST1 as described above.

Figure 4:
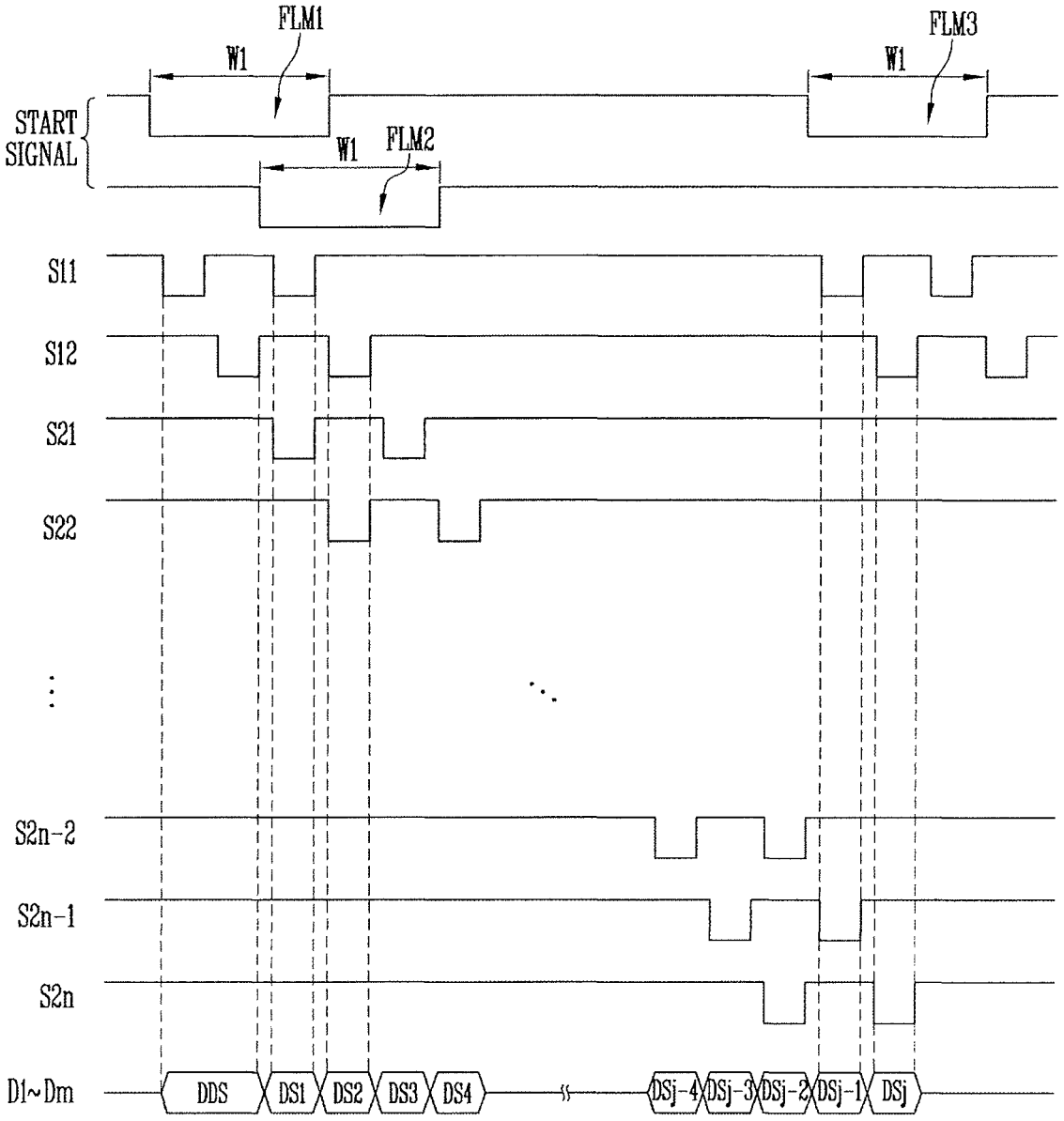
FIG. 4 illustrates an embodiment of waveforms for controlling scan drivers.

FIG. 4 illustrates an embodiment of waveforms for controlling operation of the first and second scan drivers in FIG. 1. In FIG. 4, 2i first scan signals are supplied to each of the first scan lines S11 and S12 and i second scan signals are supplied to each of the second scan lines S21 to S2*n*. In FIG. 4, i is assumed to be 2, but may be a different number in another embodiment.

Referring to FIG. 4, the timing controller 500 sequentially supplies a first start signal FLM1, a second start signal FLM2, and a third start signal FLM3 during a frame period. The first to third start signals FLM1 to FLM3 are set to have the same first width W1. For example, the first width W1 may be set such that two scan signals are supplied to a scan line during the period in which the start signals FLM1 to FLM3 are supplied.

The first scan driver 100 receives the first start signal FLM1 and supplies two first scan signals to each of the first scan lines S11 and S12. The second scan driver 200 receives the second start signal FLM2 and supplies two second scan signals to each of the second scan lines S21 to S2*n*. At this time, a secondary first scan signal out of the two first scan signals supplied to the primary first scan line S11 overlaps a primary second scan signal supplied to the primary second scan line S21. For example, in one embodiment, a secondary second scan signal supplied to a p-ary (p is a natural number) second scan line S2*p* overlaps a primary second scan signal supplied to a (p+2)-ary second scan line S2*p*+2.

The data driver 300 supplies data signals DS1 corresponding to a first horizontal line to the data lines D1 to Dm. These data signals DS1 are synchronized with the secondary first scan signal supplied to the primary first scan line S11. After that, the data driver 300 sequentially supplies data signals DS2 to DSj corresponding to second to jth horizontal lines.

The data driver 300 supplies a dummy data signal DDS to the data lines D1 to Dm before the data signal DS1 corresponding to the first horizontal line is supplied. The dummy data signal DDS may be one of the data signals from the data driver 300.

Each of the first pixels PXL1 receives the dummy data signal DDS when the primary first scan signal is supplied to a first scan line (one of S11 or S12) coupled thereto. At this time, the driving transistor in each of the first pixels PXL1 receives a bias voltage (on or off bias) corresponding to the dummy data signal DDS. When the bias voltage is applied to the driving transistor, characteristics of the driving transistor may be constantly maintained.

Subsequently, each of the first pixels PLX1 receives the data signal DS1 or DS2 when the secondary first scan signal is supplied to the first scan line (one of S11 or S12). Each of the pixels PXL1 receiving the DS1 or DS2 stores a voltage of the data signal DS1 or DS2 and generates light with a predetermined luminance corresponding to the stored voltage of the data signal DS1 or DS2.

Each of the second pixels PXL2 receive a data signal corresponding to a previous horizontal line when the primary second scan signal is supplied to a second scan line (one of S21 to S2*n*). At this time, a driving transistor in each of the second pixels PXL2 receives a bias voltage (on or off bias) corresponding to a data signal of a previous horizontal line. When the bias voltage is applied to the driving transistor, characteristics of the driving transistor may be constantly maintained.

Subsequently, each of the second pixels PXL2 receives a data signal (one of DS3 to DSj) when the secondary second scan signal is supplied to the second scan line (one of S21 to S2*n*). Each of the second pixels PXL2 receiving the data signal (one of DS3 to DSj) stores a voltage of the data signal (one of DS3 to DSj) and generates light with a predetermined luminance based on the stored voltage of the data signal (one of DS3 to DSj).

Figure 5:
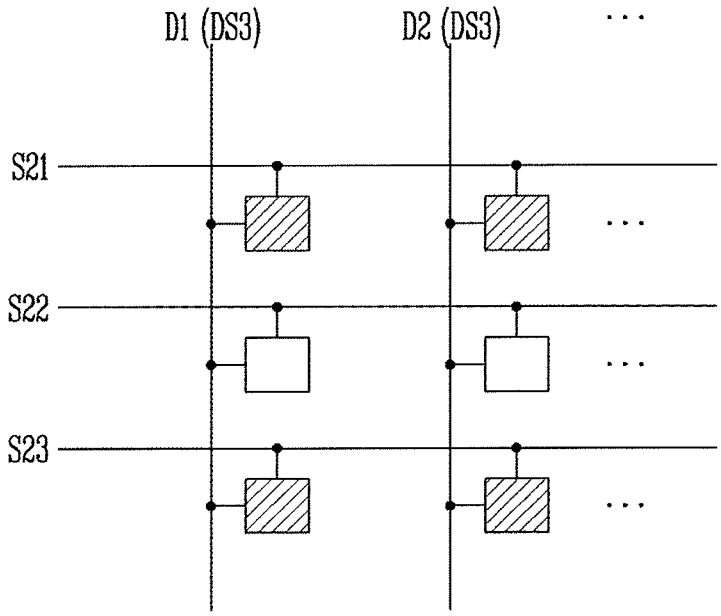
FIG. 5 illustrates an embodiment of data signals supplied to pixels according to the waveforms in FIG. 4.

In the present embodiment, the pixels PXL1 and PXL2 receive two data signals DS based on the first start signal FLM1 and the second start signal FLM2. For example, in FIG. 5, a data signal DS3 corresponding to the third horizontal line is supplied to second pixels PXL2 coupled to the primary second scan line S21 and second pixels PXL2 coupled to a tertiary second scan line S23.

Figure 6A:
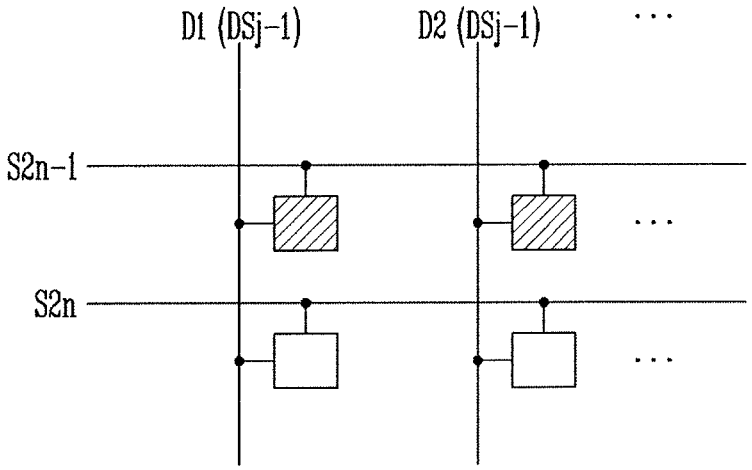
FIGS. 6A and 6B illustrate embodiments of data signals for pixels when a third start signal is not supplied.
Figure 6B:
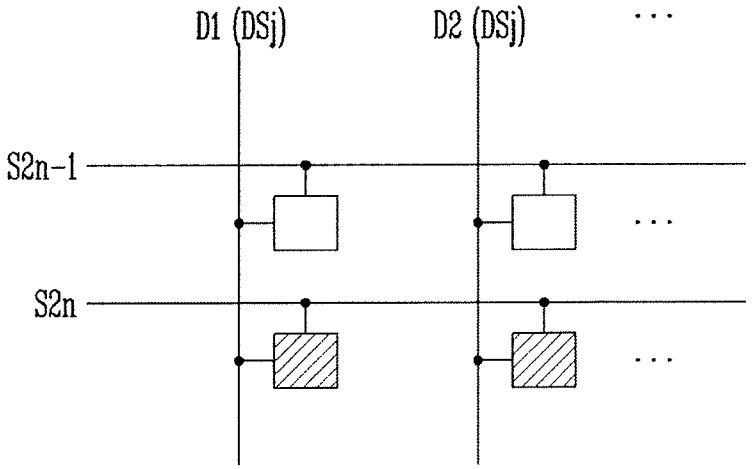

When the third start signal FLM3 is not supplied, as illustrated in FIG. 6A, a data signal DSj−1 corresponding to a (j−1)th horizontal line is supplied to only second pixels PXL2 coupled to an (n−1)-ary second scan line S2*n*−1. Similarly, in FIG. 6B, a data signal DSj corresponding to a jth horizontal line is supplied to only second pixels PXL2 coupled to an n-ary second scan line S2*n*.

Then, although the same data signal is supplied, a voltage charged in the second pixels PXL2 coupled to the (n−1)-ary second scan line S2*n*−1 and the second pixels PXL2 coupled to the n-ary second scan lines S2*n* and a voltage charged in the pixels PXL1 and PXL2 on the other horizontal lines are set to be different from each other. Therefore, an irregular image is displayed.

In order to overcome this, one type of method involves additionally forming an (n+1)-ary second scan line and second pixels coupled thereto, and an (n+2)-ary second scan line and second pixels coupled thereto. However, this method increases the amount of dead space.

In accordance with one or more embodiments, the third start signal FLM3 is additionally supplied to the first scan driver 100. The first scan driver 100 receives the third start signal FLM3 and supplies two first scan signals to each of the first scan lines S11 and S12. At least one of the first scan signals supplied to each of the first scan lines S11 and S12, corresponding to the third start signal FLM3, may overlap a second scan signal (e.g., a secondary second scan signal supplied to the n-ary second scan line S2*n*) finally supplied during a frame period.

Figure 7A:
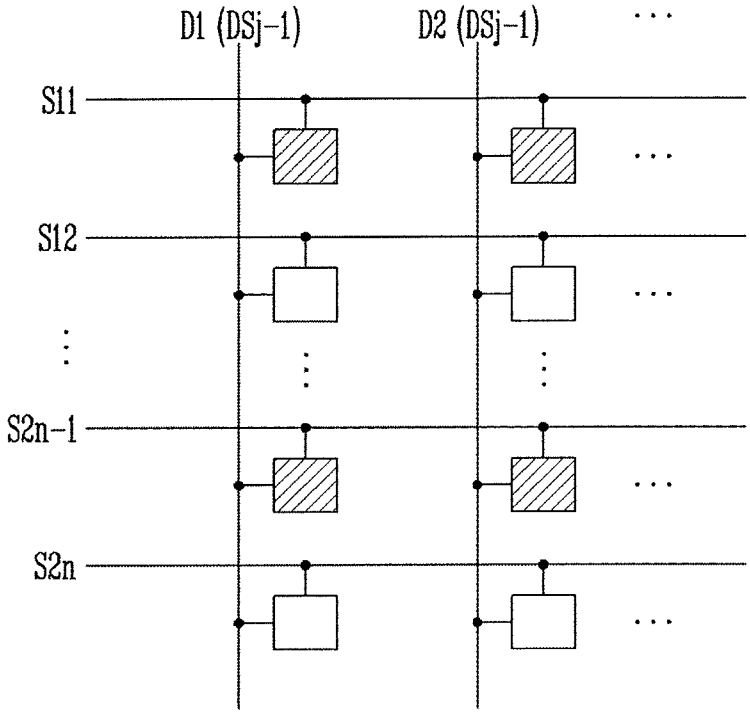
FIGS. 7A and 7B illustrate embodiments of data signals for pixels when a third start signal is supplied.

For example, a primary first scan signal supplied to the primary first scan line S11, corresponding to the third start signal FLM3, may overlap a secondary second scan signal supplied to the (n−1)-ary second scan line S2*n*−1. In this case, as illustrated in FIG. 7A, the data signal DSj−1 corresponding to the (j−1)th horizontal line is supplied to the second pixels PXL2 coupled to the (n−1)-ary second scan lines S2*n*−1 and the first pixels PXL1 coupled to the primary first scan line S11.

Figure 7B:
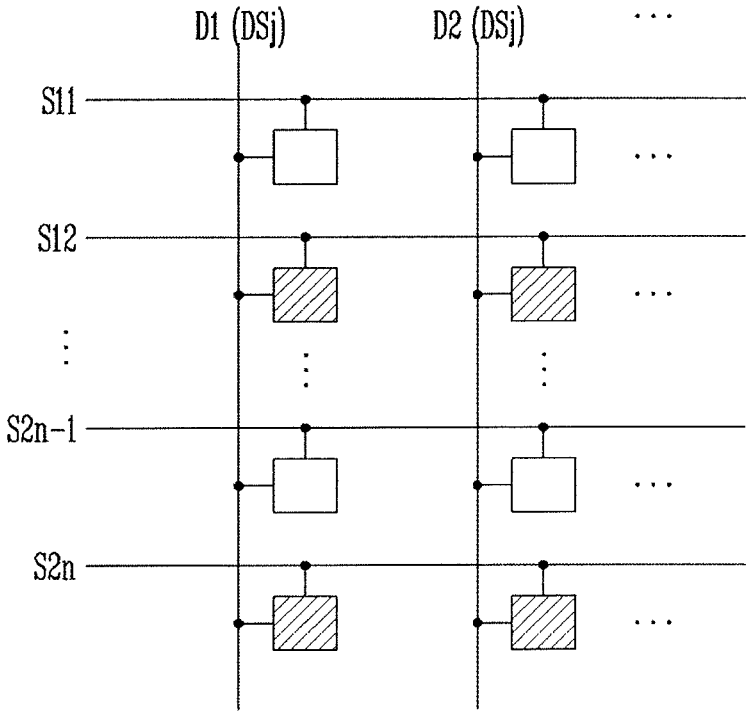

Similarly, the primary first scan signal supplied to the secondary first scan line S12 corresponding to the third start signal FLM3, may overlap the secondary second scan signal supplied to the n-ary second scan line S2*n*. In this case, as illustrated in FIG. 7B, the data signal DSj corresponding to the jth horizontal line is supplied to the second pixels PXL2 coupled to the n-ary second scan line S2*n* and the first pixels PXL1 coupled to the secondary first scan line S12.

As described above, in the present embodiment, the third start signal FLM3 is supplied to the first scan driver 100. Accordingly, the load of each of the pixels PXL1 and PXL2 may be constantly maintained when a data signal is supplied. Thus, light with uniform luminance may be emitted from the pixels PXL1 and PXL2 when the same data signal is supplied.

Figure 8:
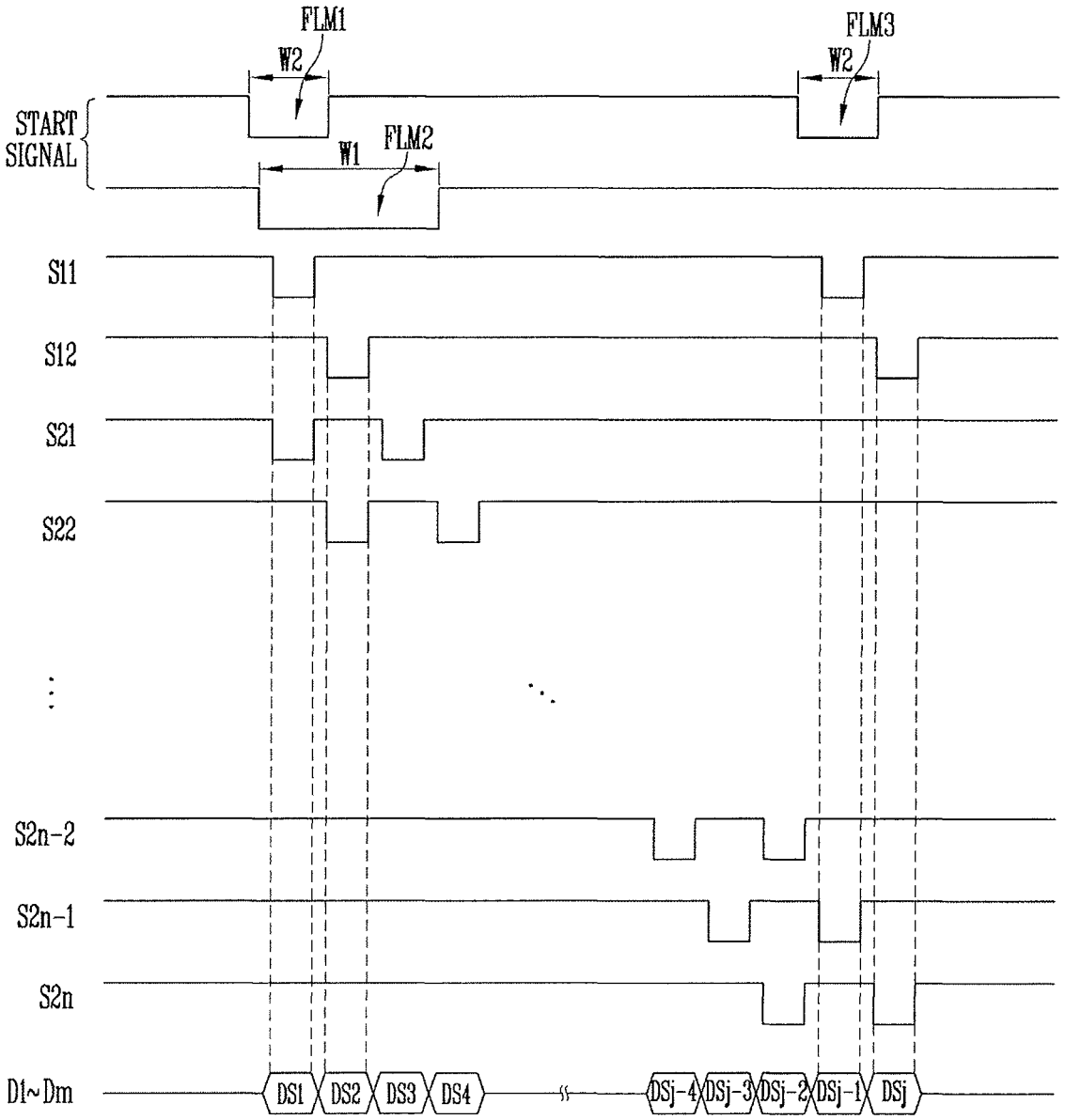
FIG. 8 illustrates another embodiment of scan drivers.

FIG. 8 illustrates another embodiment of a waveform for controlling the first and second scan drivers in FIG. 1. FIG. 8 illustrates a case where 2(i−1) first scan signals are supplied to each of the first scan lines S11 and S12, and i second scan signals are supplied to each of the second scan lines S21 to S2*n*. In FIG. 8, i=2 but may be different in another embodiment.

Referring to FIG. 8, the timing controller 500 sequentially supplies a first start signal FLM1, a second start signal FLM2, and a third start signal FLM3 during a frame period. The first start signal FLM1 and the third start signal FLM3 are set to have a second width W2 and the second start signal FLM2 is set to have a first width W1. The first width W1 may be greater than the second width W2. In one embodiment, the second width W2 may be set such that one scan signal is supplied to a scan line during a period in which the start signals FLM1 and FLM3 are supplied. In addition, the first width W1 may be set such that two scan signals are supplied to a scan line during a period in which the start signal FLM2 is supplied.

The first scan driver 100 receives the first start signal FLM1 and supplies one first scan signal to each of the first scan lines S11 and S12. The second scan driver 200 receives the second start signal FLM2 and supplies two second scan signals to each of the second scan lines S21 to S2*n*. A secondary second scan signal supplied to a p-ary second scan line S2*p* overlaps a primary second scan signal supplied to a (p+2)-ary second scan line S2*p*+2.

The data driver 300 supplies a data signal DS1 corresponding to the first horizontal line to the data lines D1 to Dm synchronized with the first scan signal supplied to the primary first scan line S11. After that, the data driver 300 sequentially supplies data signals DS2 to DSj corresponding to the second to jth horizontal lines.

The first scan driver 100 receives the third start signal FLM3 and supplies one first scan signal to each of the first scan lines S11 and S12. The first scan signal supplied to each of the first scan lines S11 and S12, corresponding to the third start signal FLM3, may overlap a second scan signal (e.g., a secondary second scan signal supplied to the n-ary second scan line S2*n*) finally supplied during a frame period.

For example, the first scan signal supplied to the primary first scan line S11, corresponding to the third start signal FLM3, may overlap a secondary second scan signal supplied to the (n−1)-ary second scan line S2*n*−1. In addition, the first scan signal supplied to the secondary first scan line S12, corresponding to the third start signal FLM3, may overlap a secondary second scan signal supplied to the n-ary second scan line S2*n*. Then, when a data signal is supplied, the load of each of the pixels PXL1 and PXL2 is constantly maintained. Thus, light with uniform luminance may be achieved.

The first pixels PXL1 receive a data signal DSj−1 or DSj when the first scan signal is supplied corresponding to the third start signal FLM3. At this time, a predetermined bias voltage is applied to the driving transistor in each of the first pixels PXL1. Thus, characteristics of the driving transistor may be constantly maintained.

Figure 9:
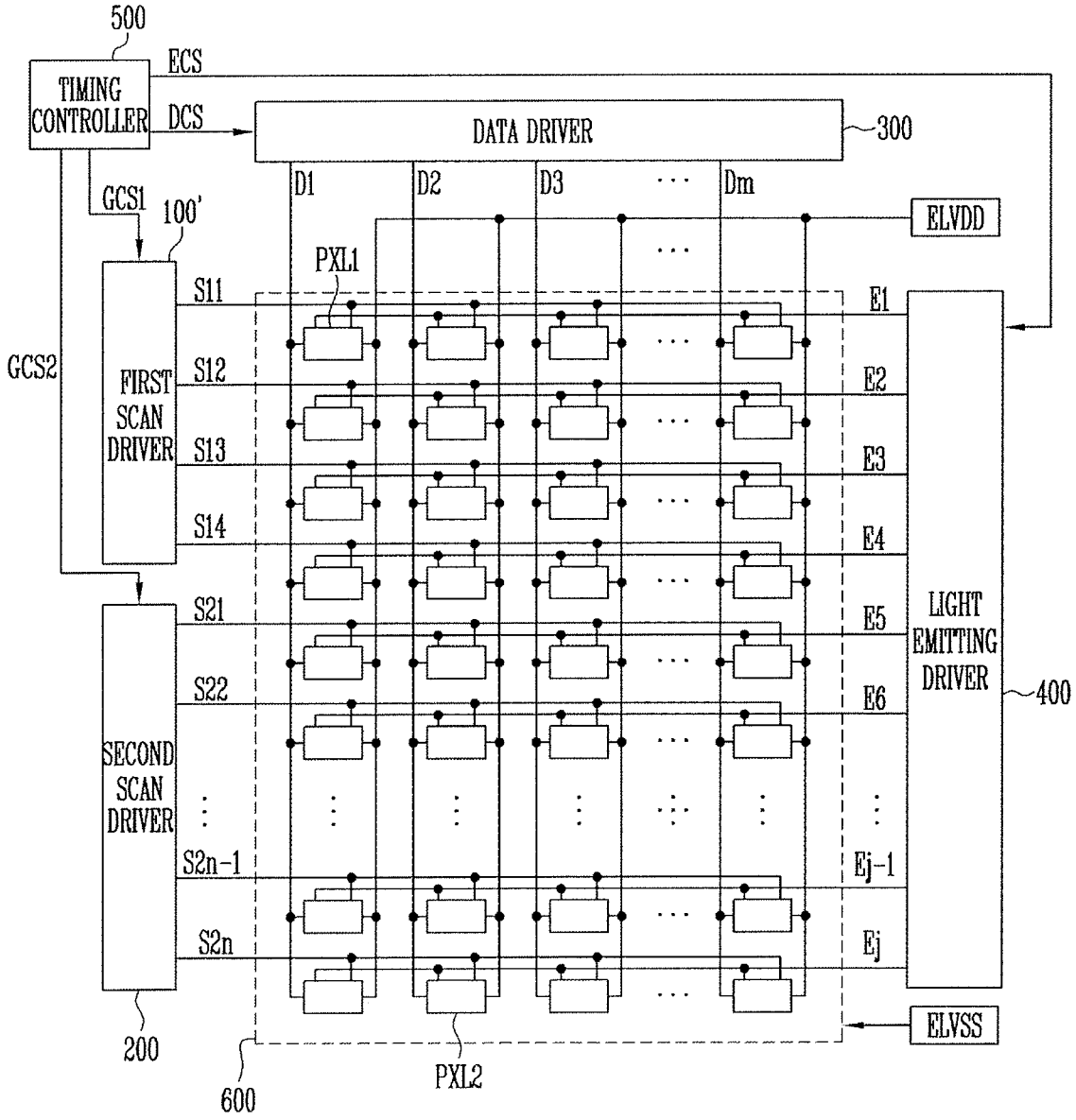
FIG. 9 illustrates another embodiment of a display device.

FIG. 9 illustrates another embodiment of a display device which includes a first scan driver 100', a second scan driver 200, a data driver 300, a light emitting driver 400, a timing controller 500, and a pixel unit 600.

The pixel unit 600 includes first pixels PXL1 and second pixels PXL2 to display a predetermined image. The first pixels PXL1 are coupled to first scan lines S11 to S14 and data lines D1 to Dm. The first pixels PXL1 are selected when a first scan signal is supplied to the first scan lines S11 to S14. The first pixels PXL1 then receive a data signal supplied from the data lines D1 to Dm. The first pixels PXL1 emit light with a predetermined luminance corresponding to the data signal. The light emitting time of the first pixels PXL1 is controlled based on a light emitting control signal from light emitting control lines E1 and E4.

The second pixels PXL2 are coupled to second scan lines S21 to S2*n* and the data lines D1 to Dm. The second pixels PXL2 are selected when a second scan signal is supplied to the second scan lines S21 to S2*n*. The second pixels PXL2 then receive a data signal from the data lines D1 to Dm. The second pixels PXL2 emit light with a predetermined luminance corresponding to the data signal. The light emitting time of the second pixels PXL2 is controlled based on a light emitting control signal from light emitting control lines E5 to Ej.

In FIG. 9, three second scan signals are supplied to each of the second scan lines S21 to S2*n* and four first scan lines S11 to S14 correspond to the three second scan signals. This may be different in another embodiment.

The first scan driver 100' supplies 2i or 2(i−1) first scan signals to each of the first scan lines S11 to S14 during a frame period based on a first gate control signal GCS1 from the timing controller 500. For example, when i is 3, the first scan driver 100' may supply six first scan signals or four first scan signals to each of the first scan lines S11 to S14. When the first scan signals are supplied to the first scan lines S11 to S14, the first pixels PXL1 are sequentially selected in units of horizontal lines.

The second scan driver 200 supplies i second scan signals to each of the second scan lines S21 to S2*n* during a frame period based on a second gate control signal GCS2. For example, the second scan driver 200 may supply three second scan signals to each of the second scan lines S21 to S2*n*. When the second scan signals are supplied to the second scan lines S21 to S2*n*, the second pixels PXL2 are sequentially selected in units of horizontal lines.

The light emitting driver 400 receives an emission control signal ECS from the timing controller 500 and may sequentially supply a light emitting control signal to the light emitting control lines E1 to Ej based on the emission control signal ECS.

The data driver 300 receives a data control signal DCS from the timing controller 500 and supplies data signals to the data lines D1 to Dm. The data signals supplied to the data lines D1 to Dm are supplied to pixels PXL1 or PXL2 selected by the first scan signal or the second scan signal.

The timing controller 500 generates the first gate control signal GCS1, the second gate control signal GCS2, the data control signal DCS, and the emission control signal ECS, based on timing signals supplied from an external source. The first gate control signal GCS1 from the timing controller 500 is supplied to the first scan driver 100'. The second gate control signal GCS2 from the timing controller 500 is supplied to the second scan driver 200. In addition, the data control signal DCS from the timing controller 500 is supplied to the data driver 300, and the emission control signal ECS from the timing controller 500 is supplied to the light emitting driver 400.

The first gate control signal GCS1 includes a first start signal, a third start signal, clock signals, and the like. The first start signal and the third start signal control the supply timing of the first scan signals. The clock signals are used as a basis for shifting the first start signal and the third start signal.

The second gate control signal GCS2 includes a second start signal, clock signals, and the like. The second start signal controls the supply timing of the second scan signals. The clock signals are used as a basis for shifting the second start signal.

The data control signal DCS includes a source start signal, a source output enable signal, a source sampling clock, and the like. The emission control signal ECS includes an emission start signal and clock signals.

Figure 10:
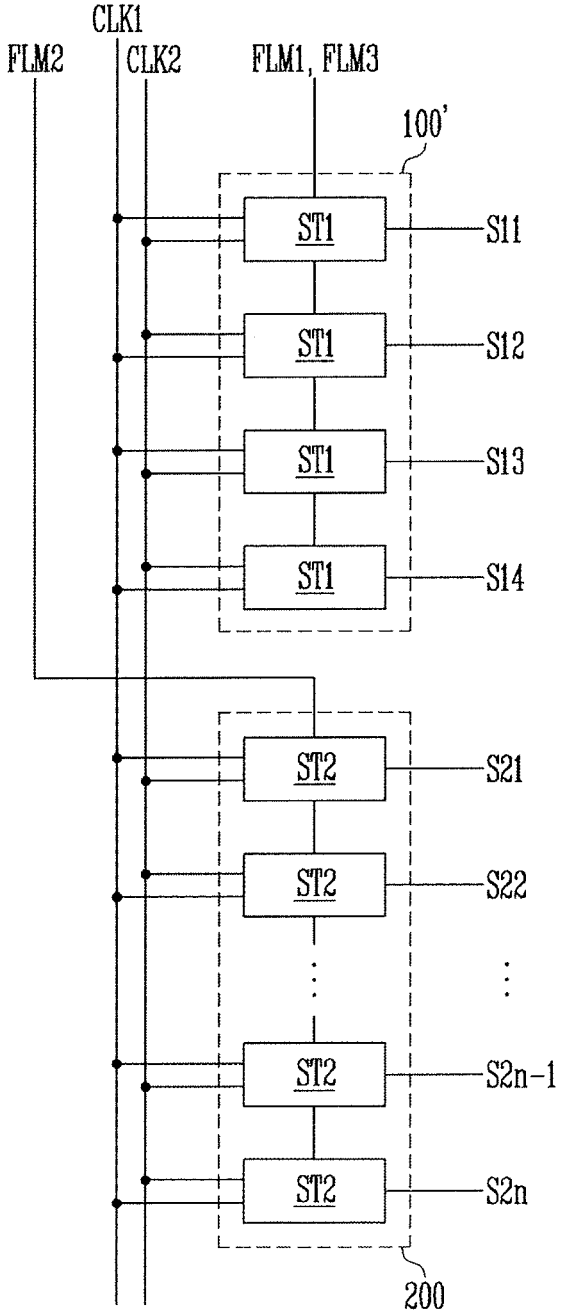
FIG. 10 illustrates another embodiment of scan drivers.

FIG. 10 illustrates an embodiment of the scan drivers in FIG. 9. Referring to FIG. 10, the first scan driver 100' includes first stages ST1 coupled to the respective first scan lines S11 to S14. The first stages ST1 receive clock signals CLK1 and CLK2 and supply first scan signals to each of the first scan lines S11 to S14 based on a first start signal FLM1 and a third start signal FLM3.

The first stages ST1 supplies first scan signals to a primary first scan line S11 based on the first start signal FLM1 and the third start signal FLM3. Each of the other first stages ST1 supplies first scan signals to a first scan line (one of S12 to S14) based on an output signal (e.g., a signal obtained by shifting the first start signal FLM1 and the third start signal FLM3) of a previous stage.

The number of the first scan signals supplied to each of the scan lines S11 to S14 is determined based on the widths of the first start signal FLM1 and the third start signal FLM3. For example, a larger number of first scan signals are supplied to each of the first scan lines S11 to S14 as the width of the first start signal FLM1 and the third start signal FLM3 increases. In an embodiment, the width of the first start signal FLM1 and the third start signal FLM3 may be controlled such that 2i or 2(i−1) first scan signals are supplied to each of the first scan lines S11 to S14.

Second stages ST2 receive the clock signals CLK1 and CLK2 and supply second scan signals to each of the second scan lines S21 to S2*n*.

A primary second stage ST2 supplies second scan signals to a primary second scan line S21 based on a second start signal FLM2. Each of the other second stages ST2 supplies second scan signals to a second scan line (one of S22 to S2*n*) based on an output signal (e.g., a signal obtained by shifting second start signal FLM2) of a previous stage.

The number of the second scan signals supplied to each of the second scan lines S21 to S2*n* is determined based on the width of the second start signal FLM2. For example, a larger number of second scan signals are supplied to each of the second scan lines S21 to S2*n* as the width of the second start signal FLM2 increases. In an embodiment, the width of the second start signal FLM2 may be controlled to supply i second scan signals to each of the second scan lines S21 to S2*n*.

In the present embodiment, the stages ST1 and ST2 may control the number of scan signals supplied to a scan line based on the width of a start signal FLM. The stages ST1 and ST2 may be implemented with various types of circuits.

Figure 11:
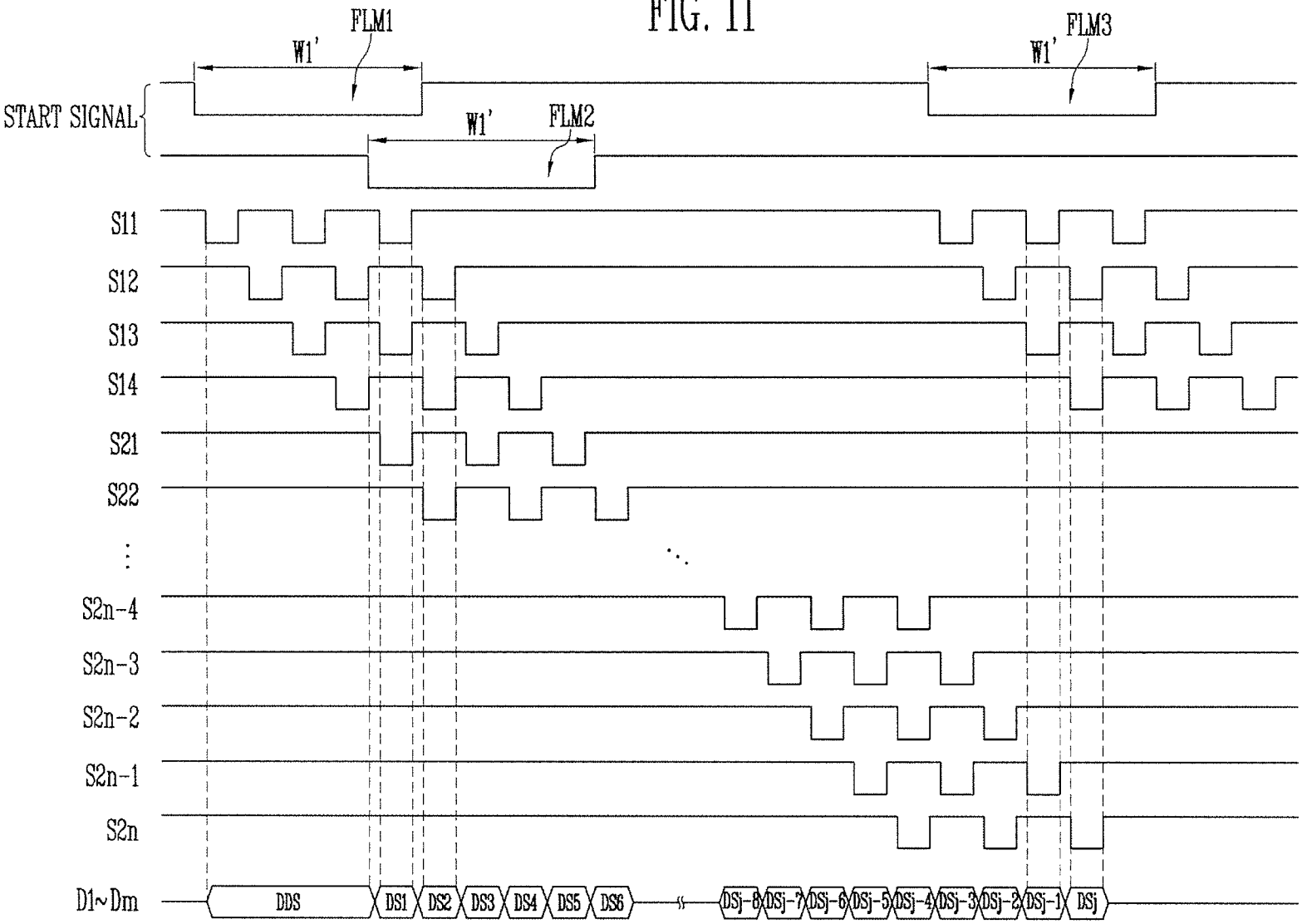
FIG. 11 illustrates another embodiment of a waveform to control scan drivers.

FIG. 11 illustrates an embodiment waveforms for controlling operation of the first and second scan drivers in FIG. 9. FIG. 11 illustrates a case where 2i first scan signals are supplied to each of the first scan lines S11 to S14, and i second scan signals are supplied to each of the second scan lines S21 to S2*n*, wherein i is 3.

Referring to FIG. 11, the timing controller 500 sequentially supplies a first start signal FLM1, a second start signal FLM2, and a third start signal FLM3 during a frame period. The first start signal FLM1 and the third start signal FLM3 are set to the same first width W1'. For example, the first width W1' may be set such that three scan signals are supplied to a scan line during the period in which the start signals FLM1 to FLM3 are supplied.

The scan driver 100' receiving the first start signal FLM1 supplies three first scan signals to each of the first scan lines S11 to S14.

The second scan driver 200 receives the second start signal FLM2 and supplies three second scan signals to each of the second scan lines S21 to S2*n*.

At this time, a secondary first scan signal among the three first scan signals supplied to the primary first scan line S11 overlaps a primary first scan signal supplied to a tertiary first scan lines S13. A tertiary first scan signal supplied to the primary first scan line S11 overlaps a primary second scan signal supplied to primary second scan line S21.

In addition, a secondary second scan signal supplied to a p-ary second scan line S2*p* overlaps a primary second scan signal supplied to a (p+2)-ary second scan line S2*p*+2. A tertiary second scan signal supplied to the p-ary second scan line S2*p* overlaps a primary second scan signal supplied to a (p+4)-ary second scan line S2*p*+4.

The data driver 300 supplies a data signal DS1 corresponding to a first horizontal line synchronized with the tertiary first scan signal supplied to the primary first scan line S11. After that, the data driver 300 sequentially supplies data signals DS2 to DSj corresponding to second to jth horizontal lines.

The data driver 300 supplies a dummy data signal DDS to the data lines D1 to Dm before the data signal DS1 corresponding to the first horizontal line is supplied. The dummy data signal DDS may be one of the data signals of the data driver 300.

Each of the first pixels PXL1 receives the dummy data signal DDS or data signal DS when the primary and secondary first scan signals are supplied to a first scan line (e.g. one of S11 to S14). At this time, a bias voltage corresponding to the dummy data signal DDS or data signal DS is applied to a driving transistor in each of the first pixels PXL1.

Each of the first pixels PXL1 receives a data signal (one of DS1 to DS4) when the tertiary first scan signal is supplied to a first scan line (one of S11 to S14). Each of the first pixels PXL1 receiving the data signal (one of DS1 to DS4) stores a voltage of the data signal (one of DS1 to DS4), and generates light with a predetermined luminance corresponding to the stored voltage of the data signal (one of DS1 to DS4).

Each of the second pixels PXL2 receives a data signal DS corresponding to a previous horizontal line when the primary and secondary second scan signals are supplied to a second scan line (one of S21 to S2*n*). At this time, a bias voltage corresponding to the data signal DS of the previous horizontal line is applied to a driving transistor in each of the second pixels PXL2.

Each of the second pixels PXL2 receives a data signal (one of DS5 to DSj) when the tertiary second scan signal is supplied to a second scan line (one of S21 to S2*n*). Each of the second pixels PXL2 receiving the data signal (one of DS5 to DSj) stores a voltage of the data signal (one of DS5 to DSj), and generates light with a predetermined luminance corresponding to the stored voltage of the data signal (one of DS5 to DSj).

The timing controller 500 supplies the third start signal FLM3 to the first scan driver 100' to constantly maintain the load of each of the pixels PXL and PXL2 when a data signal is supplied.

The first scan driver 100' receives the third start signal FLM3 and supplies three first scan signals to each of the first scan lines S11 to S14. At least one first scan signal among the first scan signals supplied to each of the first scan lines S11 to S14, corresponding to the third start signal FLM3, may overlap a second scan signal (e.g., a tertiary second scan signal supplied to an n-ary second scan line S2*n*) finally supplied during a frame period.

For example, a primary first scan signal supplied to a primary first scan line S11, corresponding to the third start signal FLM3, may overlap a tertiary second scan signal supplied to an (n−3)-ary second scan line S2*n*−3. A secondary second scan signal may overlap a tertiary second scan signal supplied to an (n−1)-ary second scan line S2*n*−1.

In addition, a primary first scan signal supplied to a secondary first scan line S12, corresponding to the third start signal FLM3, may overlap a tertiary second scan signal supplied to an (n−2)-ary second scan line S2*n*−2. A secondary second scan signal may overlap a tertiary second scan signal supplied to an n-ary second scan line Sn.

In addition, a primary first scan signal supplied to a tertiary first scan line S13, corresponding to the third start signal FLM3, may overlap a tertiary second scan signal supplied to an (n−1)-ary second scan line S2*n*−1. Also, a primary first scan signal supplied to a quaternary first scan line S14, corresponding to the third start signal FLM3, may overlap a tertiary second scan signal supplied to the n-ary second scan line S2*n*.

As described above, when the first scan signals are supplied to the first scan lines S11 to S14, corresponding to the third start signal FLM3, the load of each of the pixels PLX1 and PXL2 may be constantly maintained when the data signal is supplied. Accordingly, light with uniform luminance may be implemented in the pixel unit 600.

Figure 12:
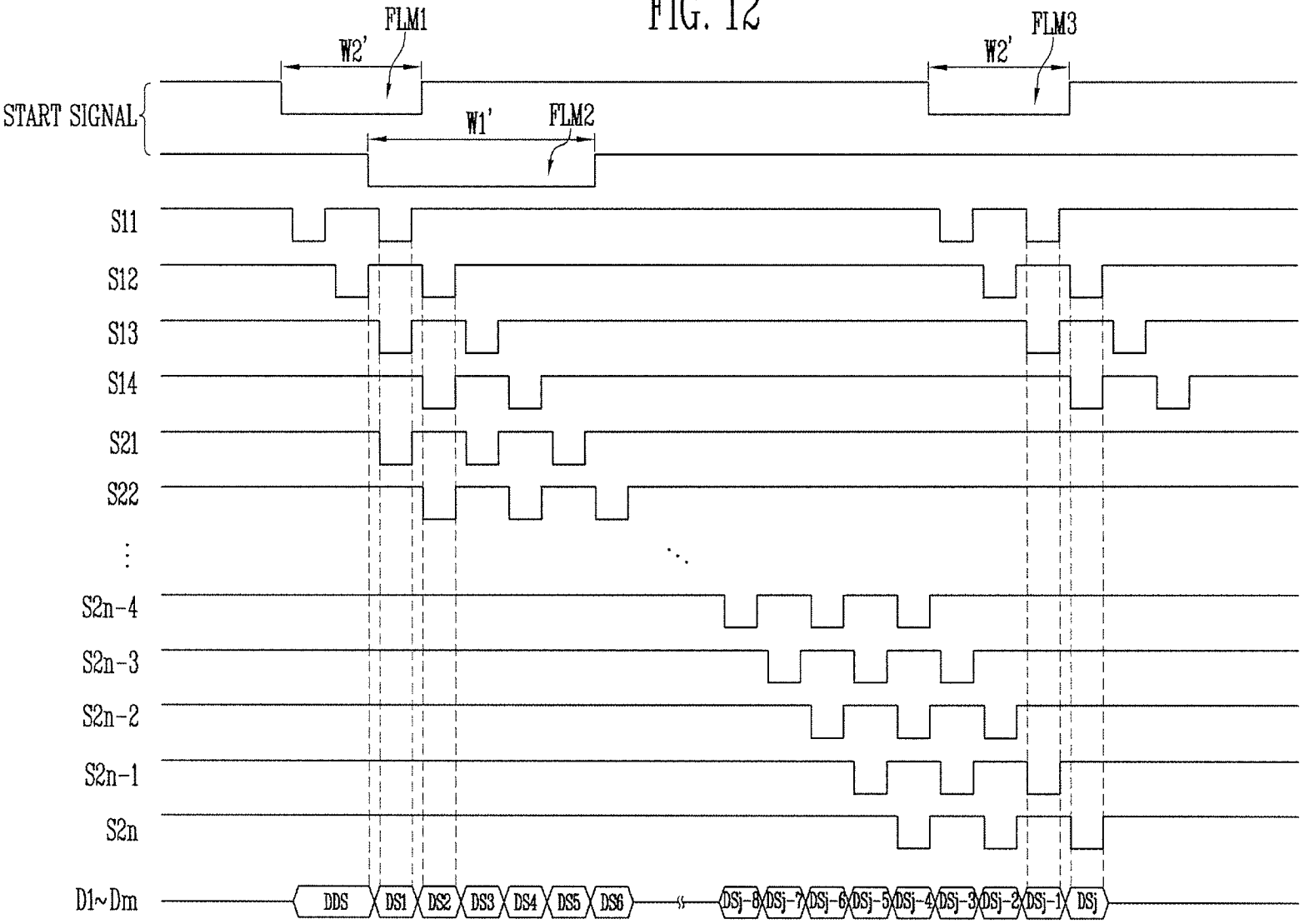
FIG. 12 illustrates another embodiment of a waveform to control scan drivers.

FIG. 12 illustrates another embodiment of waveforms for controlling the first and second scan drivers in FIG. 9. FIG. 12 illustrates a case where 2(i−1) first scan signals are supplied to each of the first scan lines S11 to S14, and i second scan signals are supplied to each of the second scan lines S21 to S2*n*. In FIG. 12, i is 3.

Referring to FIG. 12, the timing controller 500 sequentially supplies a first start signal FLM1, a second start signal FLM2, and a third start signal FLM3 during a frame period. The first start signal FLM1 and the third start signal FLM3 have a second width W2', and the second start signal FLM2 has a first width W1'. The first width W1' may be Greater than the second width W2'.

In one embodiment, the second width W2' may be set such that two scan signals are supplied to a scan line during a period in which the start signals FLM1 and FLM3 are supplied. In addition, the first width W1' may be set such that three scan signals are supplied to a scan line during a period in which the second start signal FLM2 is supplied.

The first scan driver 100' receives the first start signal FLM1 and supplies two first scan signals to each of the first scan lines S11 to S14.

The second scan driver 200 receives the second start signal FLM2 and supplies three second scan signals to each of the second scan lines S21 to S2*n*.

The data driver 300 supplies a data signal DS1 corresponding to the first horizontal line to the data lines D1 to Dm synchronized with a secondary first scan signal supplied to the primary first scan line S11. After that, the data driver 300 sequentially supplies data signals DS2 to DSj corresponding to the second to jth horizontal lines.

The first scan driver 100' receives the third start signal FLM3 and supplies two first scan signals to each of the first scan lines S11 to S14. At least one first scan signal supplied to each of the first scan lines S11 to S14, corresponding to the third start signal FLM3, may overlap a second scan signal (e.g., a tertiary second scan signal supplied to the n-ary second scan line S2*n*) finally supplied during a frame period.

For example, a primary first scan signal supplied to the primary first scan line S11, corresponding to the third start signal FLM3, may overlap a tertiary second scan signal supplied to the (n−3)-ary second scan line S2*n*−3. A secondary second scan signal may overlap a tertiary second scan signal supplied to (n−1)-ary second scan line S2*n*−1.

In addition, a primary first scan signal supplied to the secondary first scan line S12, corresponding to the third start signal FLM3, may overlap a tertiary second scan signal supplied to the (n−2)-ary second scan line S2*n*−2. A secondary second scan signal may overlap a tertiary second scan signal supplied to the n-ary second scan line S2*n*.

In addition, a primary first scan signal supplied to the tertiary first scan line S13, corresponding to the third start signal FLM3, may overlap a tertiary second scan signal supplied to the (n−1)-ary second scan line S2*n*−1. Also, a primary first scan signal supplied to the quaternary first scan line S14, corresponding to the third start signal FLM3, may overlap a tertiary second scan signal supplied to n-ary second scan line S2*n*.

As described above, when the first scan signals are supplied to the first scan lines S11 to S14, corresponding to the third start signal FLM3, the load of each of the pixels PLX1 and PXL2 may be constantly maintained when the data signal is supplied. Accordingly, light with uniform luminance may be implemented in the pixel unit 600.

Figure 13:
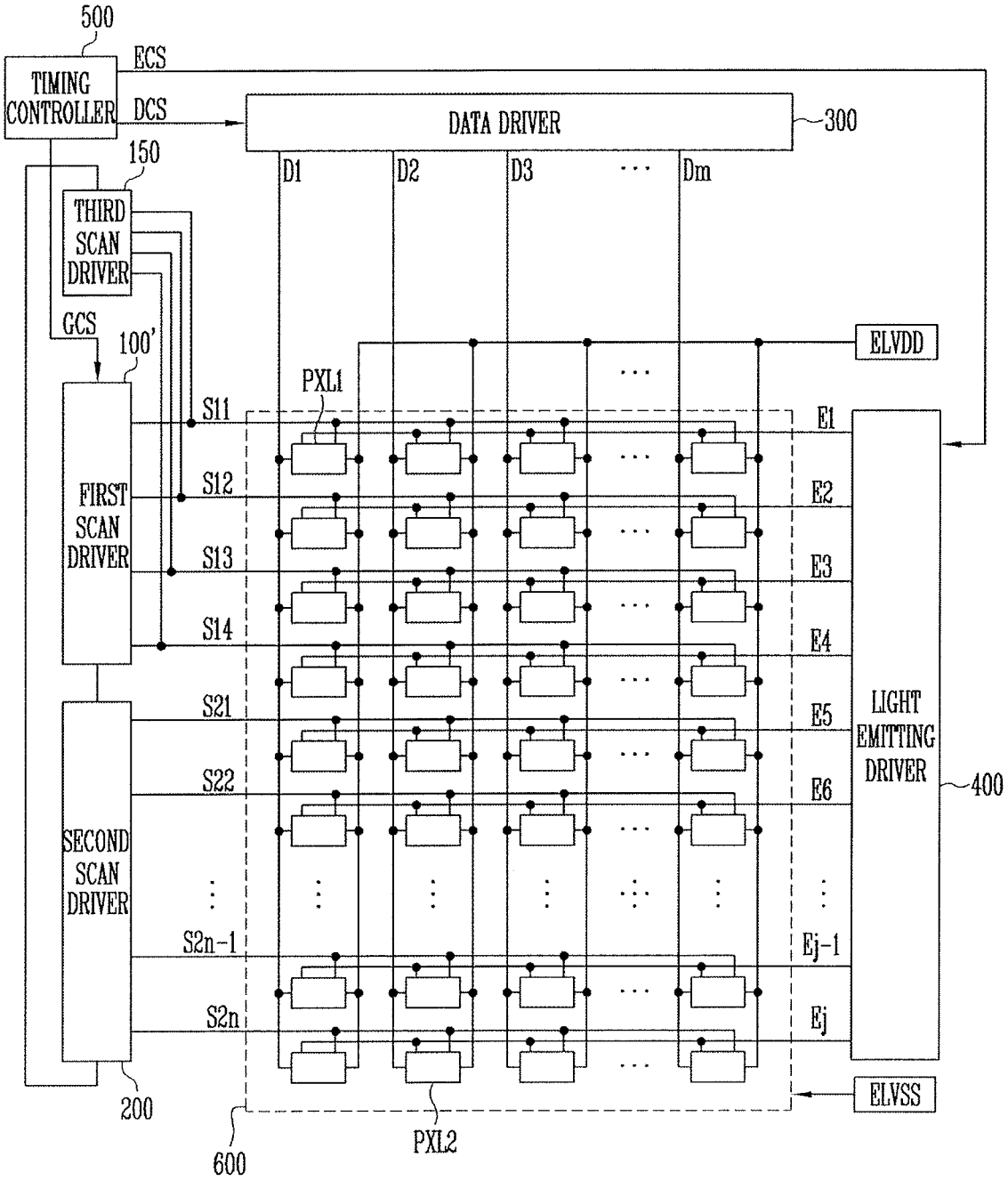
FIG. 13 illustrates another embodiment of a display device.

FIG. 13 illustrates another embodiment of a display device which includes a first scan driver 100', a second scan driver 200, a third scan driver 150, a data driver 300, a light emitting driver 400, a timing controller 500, and a pixel unit 600.

The pixel unit 600 includes first pixels PXL1 and second pixels PXL2 for displaying a predetermined image. The first pixels PXL1 are coupled to first scan lines S11 to S14 and data lines D1 to Dm. The second pixels PXL2 are coupled to second scan lines S21 to S2*n* and the data lines D1 to Dm.

The first scan driver 100' supplies i first scan signals to each of the first scan lines S11 to S14 during a frame period based on a gate control signal GCS.

The second scan driver 200 supplies i second scan signals to each of the second scan lines S21 to S2*n* during a frame period based on an output signal from the first scan driver 100'.

The third scan driver 150 supplies i third scan signals to each of the first scan lines S11 to S14 during a frame period based on an output signal from the second scan driver 200.

The light emitting driver 400 may sequentially supply a light emitting control signal to light emitting control lines E1 to Ej. The data driver 300 supplies a data signal to the data lines D1 to Dm. The timing controller 500 controls the drivers 100', 300, and 400 based on timing signals supplied from an external source.

Figure 14:
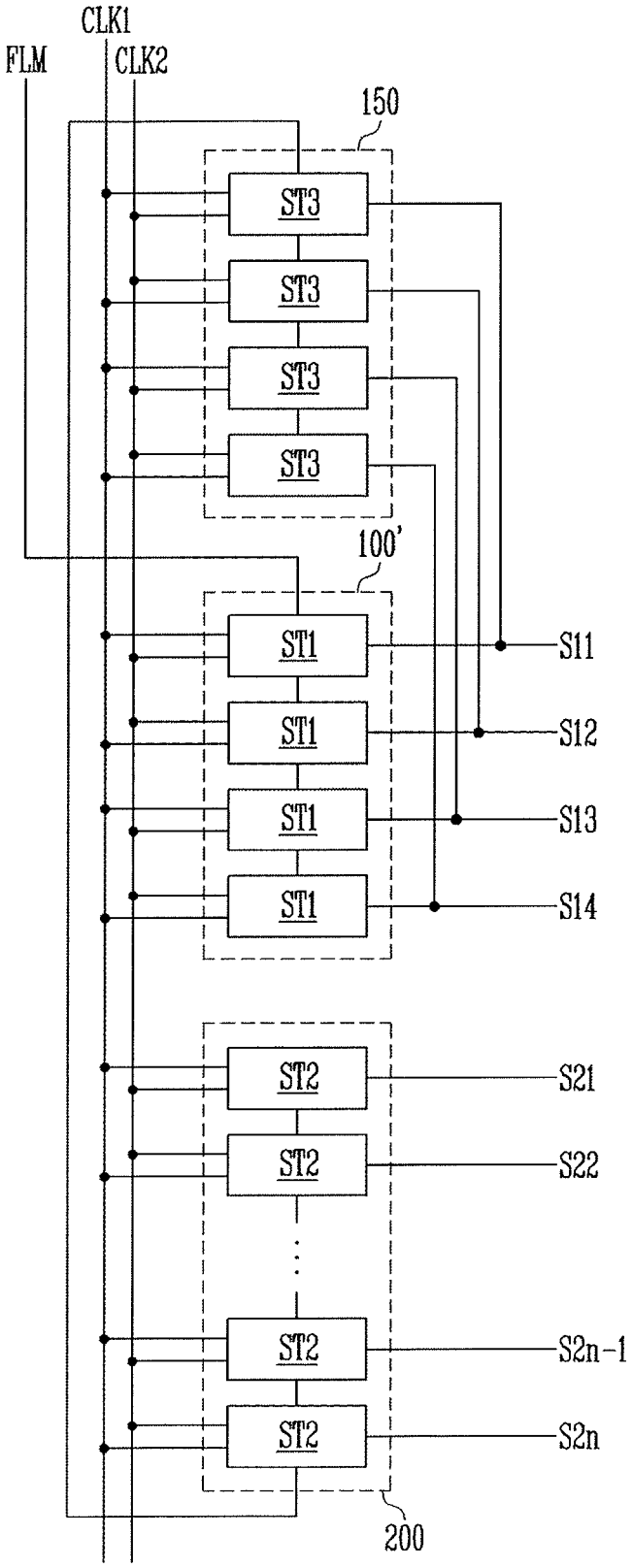
FIG. 14 illustrates another embodiment of scan drivers.

FIG. 14 illustrates an embodiment of the scan drivers in FIG. 13. Referring to FIG. 14, the first scan driver 100' includes first stages ST1 coupled to respective first scan lines S11 to S14. The first stages ST1 receive clock signals CLK1 and CLK2 and supply first scan signals to each of the first scan lines S11 to S14 based on a start signal FLM.

A primary first stage ST1 supplies first scan signals to a primary first scan line S11 based on the start signal FLM. Each of the other first stages ST1 supplies first scan signals to a first scan line (any one of S12 to S14) based on an output signal (e.g., a signal obtained by shifting the start signal FLM) of a previous stage.

The second scan driver 200 includes second stages ST2 coupled to the respective second scan lines S21 to S2*n*. The second stages ST2 receive the clock signals CLK1 and CLK2 and supply a second scan signal to each of the second scan lines S21 to S22 based on an output signal (e.g., a signal obtained by shifting the start signal FLM) of the first scan driver 100'.

A primary second stage ST2 supplies a second scan signal to a primary second scan line S21 based on an output signal of the last first stage ST1. In addition, each of the other second stages ST2 supplies a second scan signal to a second scan line (one of S22 to S2*n*) based on an output signal of a previous stage.

The third scan driver 150 includes third stages ST3 coupled to the respective first scan lines S11 to S14. The third stages ST3 receive the clock signals CLK1 and CLK2 and supply a third scan signal to each of the first scan lines S11 to S14 based on an output signal of the second scan driver 200.

A primary third stage ST3 supplies a third scan signal to the primary first scan line S11 based on an output signal of the last second stage ST2. In addition, each of the other third stages ST3 supplies a third scan signal to a first scan line (one of S12 to S14) based on an output signal of a previous stage.

Figure 15:
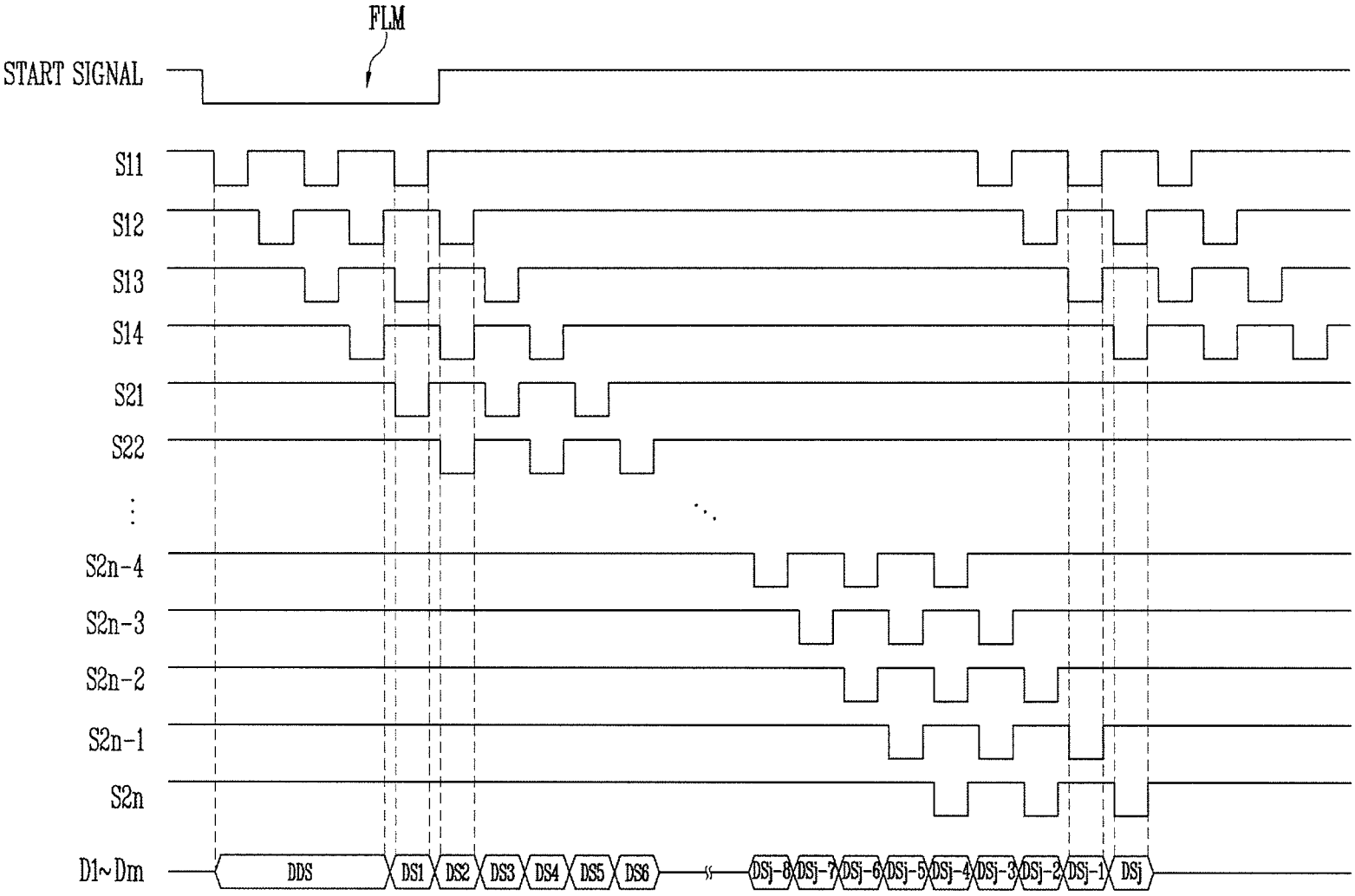
FIG. 15 illustrates another embodiment of waveforms to control scan drivers.

FIG. 15 illustrates an embodiment of waveforms for controlling the first, second, and third scan drivers in FIG. 13. In FIG. 15, i is 3. Referring to FIG. 15, the timing controller 500 supplies the start signal FLM to the first scan driver 100'. The first scan driver 100' receives the start signal FLM and supplies three first scan signals to each of the first scan lines S11 to S14.

The second scan driver 200 receives an output signal of the first scan driver 100' and supplies three second scan signals to each of the second scan lines S21 to S2*n*.

The third scan driver 150 receives an output signal of the second scan driver 200 and supplies three third scan signals to each of the first scan lines S11 to S14. At least one third scan signal supplied to each of the first scan lines S11 to S14 may overlap a second scan signal (e.g., a tertiary second scan signal supplied to an n-ary second scan line S2*n*) finally supplied during a frame period.

When the third scan signal is supplied to each of the first scan lines S11 to S14 by the third scan driver 150, the load of each of the pixels PXL1 and PXL2 may be constantly maintained when a data signal is supplied. Thus, an image with uniform luminance may be implemented in the pixel unit 600.

Figure 16:
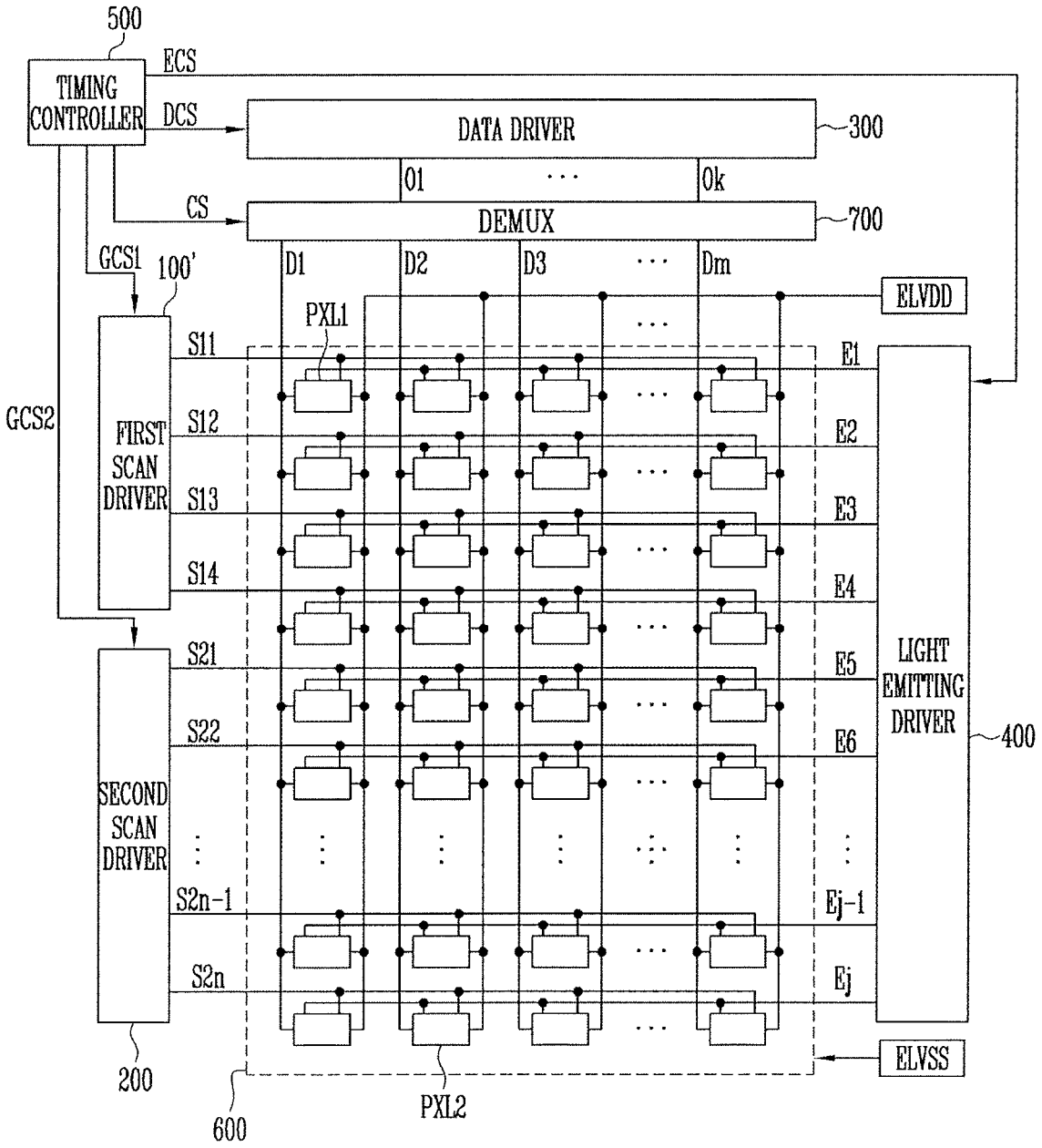
FIG. 16 illustrates another embodiment of a display device.

FIG. 16 illustrates another embodiment of a display device which additionally includes a demultiplexer (DEMUX) 700. The DEMUX 700 supplies a plurality of data signals to output lines O1 to Ok, which are coupled to data lines. The DEMUX 700 may allow the number of the output lines O1 to Ok of the data driver 300 to be reduced. As a result, manufacturing cost of the display device may be lowered. The DEMUX 700 may be driven based on a control signal from the timing controller 500. The DEMUX 700 may be various types of DEMUXes including a 1:2 DEMUX, a 1:3 DEMUX, a 1:4 DEUX, and the like.

Figure 17:
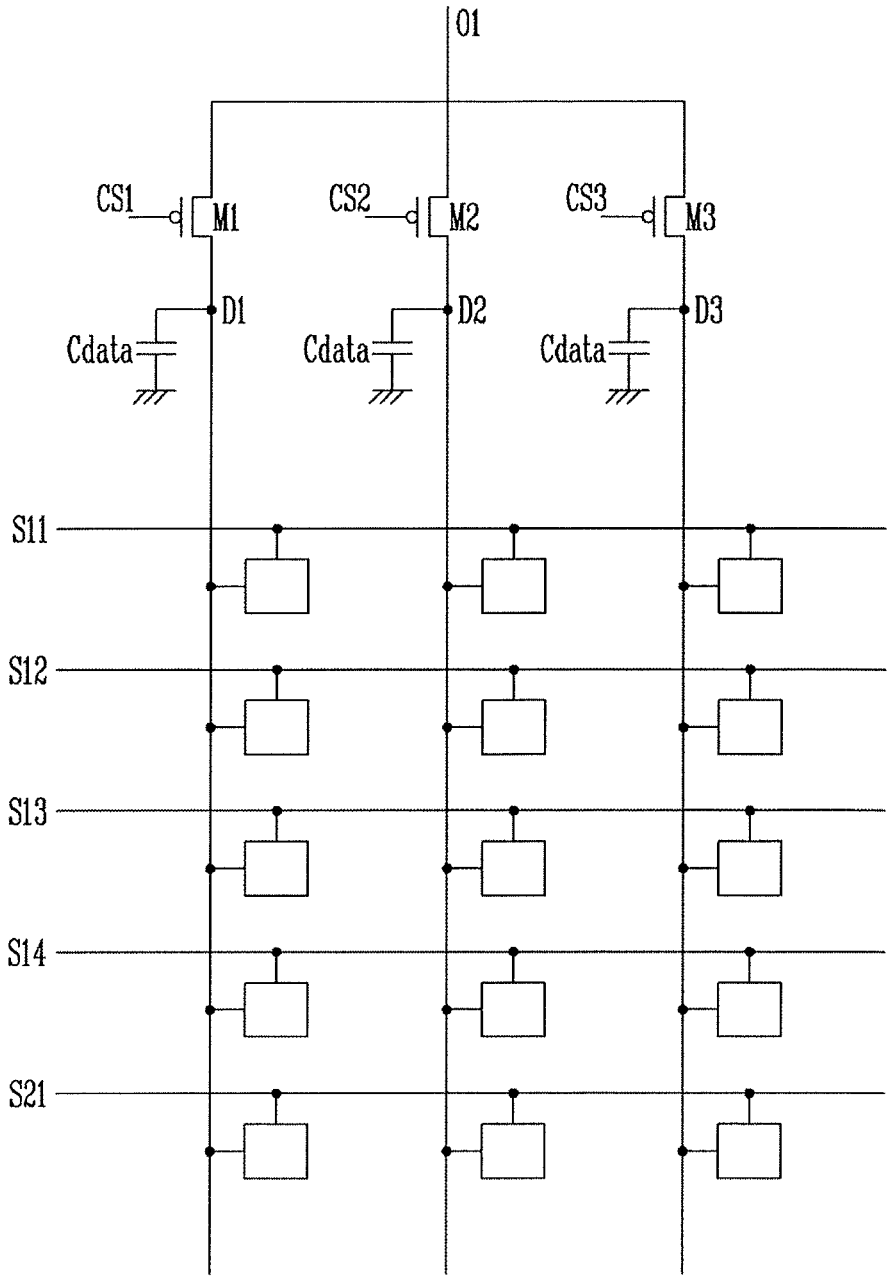
FIG. 17 illustrates an embodiment of a demultiplexer.

FIG. 17 illustrates an embodiment of the DEMUX in FIG. 16. In FIG. 17, the DEMUX 700 is a 1:3 DEMUX. Only transistors M1 to M3 coupled to a first output line O1 are illustrated for convenience of description.

Referring to FIG. 17, a first transistor M1 is between the first output line O1 and a first data line D1. A second transistor M2 is between the first output line O1 and a second data line D2. In addition, a third transistor M3 is between the first output line O1 and a third data line D3.

Figure 18:
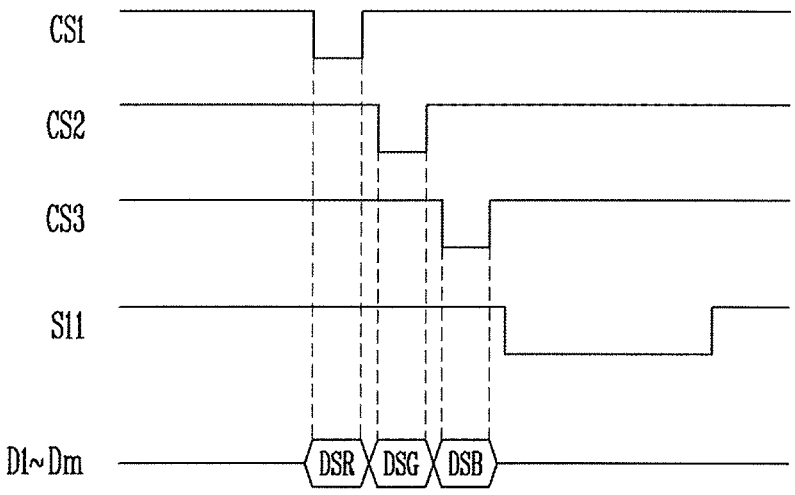
FIG. 18 illustrates an embodiment of a waveform to control the demultiplexer.

As shown in FIG. 18, the first transistor M1 is turned on when a first control signal CS1 is supplied to supply a data signal DSR from the output line O1 to the first data line D1. The data signal DSR supplied to the first data line D1 is precharged in a data capacitor Cdata equivalently formed at the first data line D1.

The second transistor M2 is turned on when a second control signal CS2 is supplied to supply a data signal DSG from the output line O1 to the second data line D2. The data signal DSG supplied to the second data line D2 is precharged in a data capacitor Cdata equivalently formed at the second data line D2.

The third transistor M3 is turned on when a third control signal CS3 is supplied to supply a data signal DSB from the output line O1 to the third data line D3. The data signal DSB supplied to the third data line D3 is precharged in a data capacitor Cdata equivalently formed at the third data line D3.

After the data signals DSR, DSG, and DSB are precharged in the data capacitors Cdata, a first scan signal is supplied to a primary first scan line S11. When the first scan signal is supplied to the primary first scan line S11, the data signals DSR, DSG, and DSB precharged in the data capacitors Cdata are supplied to first pixels PXL1 coupled to the primary first scan line S11.

Figure 19:
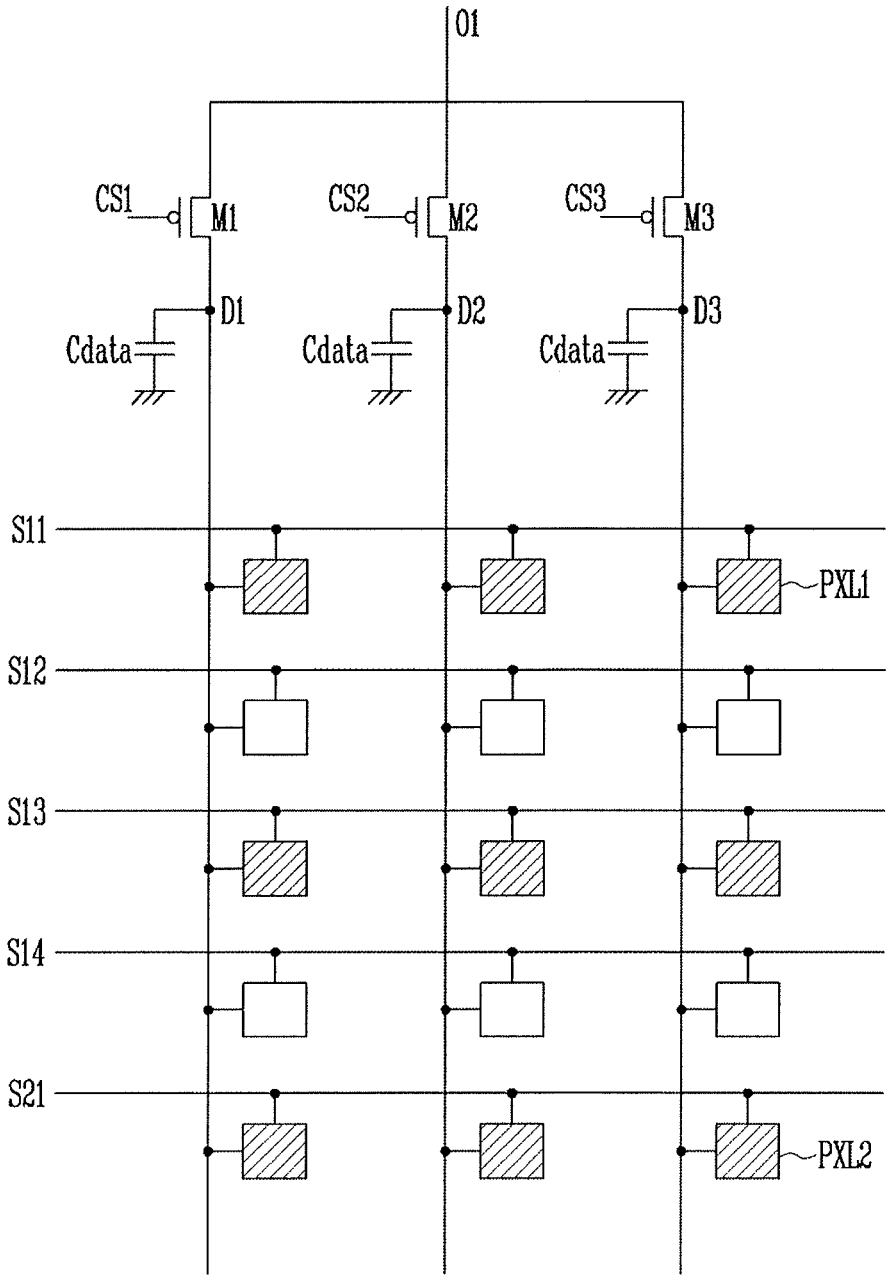
FIG. 19 illustrates an embodiment of data signals to be output by the DEMUX to pixels.

The data signals DSR, DSG, and DSB are precharged in the data capacitor Cdata, based on the driving method in FIG. 19. The data signals DSR, DSG, and DSB may be supplied to first pixels PXL1 coupled to a tertiary first scan line S13 and second pixels PXL2 coupled to a primary second scan line S21. For example, the data signal stored in the data capacitor Cdata is supplied to three pixels PXL1 and PXL2 in a charge sharing manner. When a data signal is supplied in the charge sharing manner, the load of each of the pixels PXL1 and PXL2 may be constantly maintained.

In one embodiment, the data signal stored in the data capacitor Cdata may be supplied to the same number of pixels in order to implement an image of a uniform luminance. In one embodiment, when a data signal is supplied, the load of each pixel may be constantly maintained without adding separate dummy lines and dummy pixels. Thus, even though a data signal is supplied in the charge sharing manner, an image of a uniform luminance may be implemented.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The drivers, controllers, and other processing features of the embodiments disclosed herein may be implemented in logic which, for example, may include hardware, software, or both. When implemented at least partially in hardware, the drivers, controllers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the drivers, controllers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, a display device and a method for driving a display device supplies 2i or 2(i−1) first scan signals to the first scan lines based on a first start signal and a third start signal, and i second scan signals are supplied to the second scan lines based on the second start signal. The first scan signal generated by the third start signal may overlap at least one second signal to constantly maintain the load of each of the pixels. Thus, an image of uniform luminance may be implemented without increasing dead space.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. A display device, comprising:

a plurality of first pixels coupled to first scan lines and data lines; and a plurality of second pixels coupled to second scan lines and the data lines, wherein each of the first scan lines is to receive first scan signals during a first period of a frame period, each of the second scan lines is to receive second scan signals during a second period of the frame period, and each of the first scan lines is to receive the first scan signals during a third period of the frame period, the first scan signals and the second scan signals are set to a gate-on voltage, at least one first scan signal of the first scan signals overlaps at least one second scan signal of the second scan signals, and the first period and the second period are partially overlapped, the second period and the third period are partially overlapped, and the first period and the third period are not overlapped.

2. The display device as claimed in claim 1, further comprising:

a first scan driver to supply the first scan signals to each of the first scan lines; and a second scan driver to supply the second scan signals to each of the second scan lines.

3. The display device as claimed in claim 2, further comprising:

a timing controller to supply a first start signal and a third start signal to the first scan driver and to supply a second start signal to the second scan driver.

4. The display device as claimed in claim 3, wherein the second scan driver is to supply the second scan signals to each of the second scan lines based on the second start signal.

5. The display device as claimed in claim 4, wherein the first scan driver is to:

supply some first scan signals of the first scan signals to each of the first scan lines based on the first start signal; and supply other first scan signals of the first scan signals to each of the first scan lines based on the second start signal.

6. The display device as claimed in claim 5, wherein a first scan signal, among the first scan signals supplied to each of the first scan lines based on the second start signal, is to overlap a second scan signal of the second scan signals finally supplied during the frame period.

7. The display device as claimed in claim 3, wherein the first start signal and the second start signal have a same width.

8. The display device as claimed in claim 3, wherein the timing controller is to sequentially supply the first start signal, the second start signal, and the third start signal.

9. The display device as claimed in claim 1, further comprising:

a first scan driver to supply some first scan signals of the first scan signals to each of the first scan lines;

a second scan driver to supply the second scan signals to each of the second scan lines; and a third scan driver to supply the first scan signals to each of the first scan lines.

10. The display device as claimed in claim 9, wherein the second scan driver is to output the second scan signals based on an output signal of the first scan driver.

11. The display device as claimed in claim 9, wherein the third scan driver is to output the first scan signals based on an output signal of the second scan driver.

12. The display device as claimed in claim 9, further comprising:

a timing controller to supply a start signal to the first scan driver.

13. The display device as claimed in claim 1, further comprising:

a data driver to supply a data signal to the data lines; and a light emitting driver to supply a light emitting control signal to light emitting control lines coupled to the first pixels and the second pixels.

14. The display device as claimed in claim 13, further comprising:

a demultiplexer coupled between the data driver and the data lines.

15. A display device, comprising:

a plurality of first pixels coupled to first scan lines and data lines;

a plurality of second pixels coupled to second scan lines and the data lines;

a first scan driver to supply first scan signals to each of the first scan lines during a first period of a frame period and to supply the first scan signals to each of the first scan lines during a third period of the frame period; and a second scan driver to supply second scan signals to each of the second scan lines during a second period of the frame period, wherein at least one first scan signal of the first scan signals overlaps at least one second scan signal of the second scan signals, the first scan signals and the second scan signals are set to a gate-on voltage, and the first period and the second period are partially overlapped, the second period and the third period are partially overlapped, and the first period and the third period are not overlapped.

16. The display device as claimed in claim 15, further comprising:

a timing controller to supply a first start signal and a third start signal to the first scan driver and to supply a second start signal to the second scan driver.

17. The display device as claimed in claim 16, wherein the first start signal and the third start signal have a narrower width than the second start signal.

18. The display device as claimed in claim 16, wherein the timing controller is to sequentially supply the first start signal, the second start signal, and the third start signal.

19. The display device as claimed in claim 16, wherein the second scan driver is to sequentially supply the second scan signals to each of the second scan lines based on the second start signal.

20. The display device as claimed in claim 19, wherein the first scan driver is to:

supply the first scan signals to each of the first scan lines when the first start signal is supplied; and supply the first scan signals to each of the first scan lines when the third start signal is supplied.

21. The display device as claimed in claim 15, further comprising:

a data driver to supply a data signal to the data lines; and a light emitting driver to supply a light emitting control signal to light emitting control lines coupled to the first pixels and the second pixels.

22. The display device as claimed in claim 21, further comprising:

a DEMUX coupled between the data driver and the data lines.

* * * * *